US012680197B2

(12) United States Patent
Sodano et al.

(10) Patent No.: US 12,680,197 B2
(45) Date of Patent: Jul. 14, 2026

(54) ARAMID NANOFIBER FILAMENTS AND RELATED METHODS

(71) Applicant: REGENTS OF THE UNIVERSITY OF MICHIGAN, Ann Arbor, MI (US)

(72) Inventors: Henry A. Sodano, Ann Arbor, MI (US); Hyun Chan Kim, Ann Arbor, MI (US)

(73) Assignee: REGENTS OF THE UNIVERSITY OF MICHIGAN, Ann Arbor, MI (US)

( * ) Notice: Subject to any disclaimer, the term of this patent is extended or adjusted under 35 U.S.C. 154(b) by 106 days.

(21) Appl. No.: 18/541,558

(22) Filed: Dec. 15, 2023

(65) Prior Publication Data

US 2024/0337046 A1 Oct. 10, 2024

Related U.S. Application Data

(60) Provisional application No. 63/433,087, filed on Dec. 16, 2022.

(51) Int. Cl.
*D01D 5/06* (2006.01)
*D01D 5/14* (2006.01)
(Continued)

(52) U.S. Cl.
CPC ..... *D01D 5/06* (2013.01); *D01D 5/14* (2013.01); *D01D 10/02* (2013.01); *D01D 10/06* (2013.01);
(Continued)

(58) Field of Classification Search
CPC D01D 5/06; D01D 5/14; D01D 10/02; D01D 10/06; D01F 1/02; D01F 6/605; D10B 2331/021
See application file for complete search history.

(56) References Cited

U.S. PATENT DOCUMENTS 4,078,034 A * 3/1978 Lewis ..... D01F 6/605 264/181
5,589,125 A * 12/1996 Zikeli ..... D01D 10/00 264/211.13
(Continued)

FOREIGN PATENT DOCUMENTS

WO WO-02092894 A1 * 11/2002 ..... F16G 1/28

OTHER PUBLICATIONS

Kim et al., "Ultra-High Toughness Fibers Using Controlled Disorder of Assembled Aramid Nanofibers", *Advanced Functional Materials*, 2023, 33, 2208661 (published online Nov. 22, 2022), 9 pages.
(Continued)

*Primary Examiner* — Nahida Sultana
(74) *Attorney, Agent, or Firm* — MARSHALL, GERSTEIN & BORUN LLP

(57) ABSTRACT

The disclosure relates to a method for forming nanofiber-assembled filaments in which an aromatic polyamide nanofiber suspension is first formed into wet nanofiber-assembled filaments via wet-spinning and protonation in a coagulation medium including at least one proton donor along with a non-solvent for the aromatic polyamide. The wet nanofiber-assembled filaments are then drawn to reduce/remove voids in the nanofiber-assembled filaments and improve the mechanical properties of the assembled filaments. The method can be used as a recycling method for used aromatic polyamide fiber/filament materials in which the recycled filaments have high/good mechanical properties relative to virgin filament materials.

25 Claims, 6 Drawing Sheets

(51) Int. Cl.

| | |
|---|---|
| ***D01D 10/02*** | (2006.01) |
| ***D01D 10/06*** | (2006.01) |
| ***D01F 1/02*** | (2006.01) |
| ***D01F 6/60*** | (2006.01) |

(52) U.S. Cl.
CPC ..... *D01F 1/02* (2013.01); *D01F 6/605* (2013.01); *D10B 2331/021* (2013.01)

(56) References Cited

U.S. PATENT DOCUMENTS

| | | | | |
|---|---|---|---|---|
| 6,569,366 | B1 * | 5/2003 | Toyohara | D01F 6/605 264/210.7 |
| 7,932,192 | B2 * | 4/2011 | Fujisawa | D06N 3/0004 442/164 |
| 10,208,402 | B2 * | 2/2019 | Zikeli | D01D 5/06 |
| 2009/0054620 | A1 * | 2/2009 | Takiue | D01F 6/605 264/178 F |
| 2010/0247908 | A1 * | 9/2010 | Velev | D01F 1/10 264/165 |
| 2013/0288050 | A1 * | 10/2013 | Arruda | B32B 5/22 428/401 |
| 2014/0308449 | A1 * | 10/2014 | Zhamu | D01F 9/12 427/372.2 |
| 2017/0356102 | A1 * | 12/2017 | Shen | D01D 5/12 |
| 2022/0001597 | A1 | 1/2022 | Sodano et al. | |

OTHER PUBLICATIONS

Kim et al., "Fabrication and Characterization of Nanocomposite Based on Aramid Nanofibers", *Proc. SPIE 12045*, Nano-, Bio-, Info-Tech Sensors, and Wearable Systems, 2022, 1204506 (Apr. 18, 2022); https://doi.org/10.1117/12.2613123, (Event: SPIE Smart Structures + Nondestructive Evaluation Event, Long Beach, Mar. 6-9, 2022), 6 pages.

Liu et al., "Super-Tough and Environmentally Stable Aramid Nanofiber@MXene Coaxial Fibers With Outstanding Electromagnetic Interference Shielding Efficiency", *Nano-Micro Lett.*, 2022, 14:111 (published online Apr. 24, 2022), 14 pages.

Liu et al., "Nanofibrous Kevlar Aerogel Threads for Thermal Insulation in Harsh Environments", *ACS Nano*, 2019, 13, pp. 5703-5711.

* cited by examiner

ARAMID NANOFIBER FILAMENTS AND RELATED METHODS

CROSS REFERENCE TO RELATED APPLICATION

Priority is claimed to U.S. Provisional Application No. 63/433,087 (filed Dec. 16, 2022), which is incorporated herein in its entirety.

STATEMENT OF GOVERNMENT INTEREST

This invention was made with government support under W911NF-18-1-0061 awarded by the Army Research Office and under FA9550-21-1-0019 awarded by the Air Force Office of Scientific Research. The government has certain rights in the invention.

BACKGROUND OF THE DISCLOSURE

Field of the Disclosure

The disclosure relates to a method for forming nanofiber-assembled filaments in which an aromatic polyamide nanofiber suspension is first formed into wet nanofiber-assembled filaments via wet-spinning and protonation in a coagulation medium including at least one proton donor along with a non-solvent for the aromatic polyamide. The wet nanofiber-assembled filaments are then drawn to reduce/remove voids in the nanofiber-assembled filaments and improve the mechanical properties of the assembled filaments.

Background

Nanomaterials have emerged as integral components in the design of new classes of macroscale materials with unprecedented functionalities for structural, electrical, and medical applications. The reduction of defect density at a nanoscale level allows nanomaterials to exhibit exceptional physical, chemical, mechanical, electrical, and thermal properties. When confined to the nanoscale, materials exhibit extraordinary strength, stiffness, and toughness due to size effects and the low probability of defects. However, nanomaterials have been restricted mainly in structural applications to nanofillers and additives that allow for tailoring of the mechanical performance in nanocomposites and hybrid structures. Recently, the re-assembly of nanoscale building blocks into well-ordered macroscale architectures has emerged as a promising approach to exploit nanomaterials in the fabrication of simultaneously strong and tough structures.

Some assembly techniques and methods to attain hierarchical ordering have been developed to convert nanoscale building blocks into macro and micro scale synthetic materials. These methods typically utilize self-organizing properties into higher-order structures by relying on chemical interactions, entropy, electrical field, or evaporation-based planar confinement. One strategy is the combination of colloidal self-assembly with extrusion-based methods such as wet spinning. This manufacturing approach allows for the directed organization of colloidal building blocks into macroscale structures in a convenient, versatile and controllable manner. Nonetheless, the self-organization of nanomaterials into macroscopic structures remains a challenging task due to the highly multidisciplinary nature of self-assembly processes which requires balancing chemistry and manufacturing parameters to produce complex macroscale structures with excellent mechanical properties.

Aramid nanofibers (ANFs) are a type of organic nanoscale building block that can be obtained in the form of colloidal suspensions through the disassembly of macroscale aramid fibers (e.g., KEVLAR) using a dissolution and deprotonation process. Due to use of aramid nanofibers in a variety of applications for instance aramid-based soft body armor, there exists a large waste stream, which provides an opportunity to recycle and up-scale waste materials into high value products. For example, ANFs have been successfully used as nanofillers in polymer nanocomposites, interfacial and interlaminar reinforcement in fiber-reinforced composites, or have been assembled to form membranes and bucky papers for a wide range of applications.

ANFs also display self-assembly properties that make them compatible with reprocessing via protonation, where hydrogen bonding interactions can be reintroduced to strengthen the material by reprotonating NH (amino) groups in the recycled ANFs. However, current approaches to assembly of ANFs yield structures whose mechanical properties are considerably inferior to those of their precursor.

SUMMARY

In one aspect, the disclosure relates to a method for forming nanofiber-assembled filaments, the method comprising: providing a (colloidal) nanofiber suspension comprising aromatic polyamide (or aramid) nanofibers dispersed therein; wet-spinning the nanofiber suspension into a coagulation medium (or bath) comprising at least one non-solvent for the aromatic polyamide nanofibers and at least one proton donor, thereby forming wet (or gel-state) nanofiber-assembled filaments (e.g., protonated nanofiber filaments) in the coagulation medium; optionally washing the wet nanofiber-assembled filaments; drawing (or stretching) the wet (or washed) nanofiber-assembled filaments (e.g., to a preselected extensional strain), thereby reducing or removing voids in the nanofiber-assembled filaments; optionally drying the wet (or washed) nanofiber-assembled filaments, thereby forming dry nanofiber-assembled filaments; and optionally annealing the dry nanofiber-assembled filaments, thereby forming annealed nanofiber-assembled filaments. As described in more detail below, aromatic polyamide or aramid polymer forming the nanofibers can include one or more homopolymers (e.g., with only aromatic amide repeat units) and/or one or more copolymers (e.g., with aromatic amide repeat units and optionally other repeat units (i.e., non-aromatic amide units)).

In another aspect, the disclosure relates to a method for forming nanofiber-assembled filaments, the method comprising: providing a nanofiber suspension comprising aromatic polyamide nanofibers dispersed therein; and wet-spinning the nanofiber suspension into a coagulation medium comprising at least one non-solvent for the aromatic polyamide nanofibers and at least one proton donor, thereby forming wet nanofiber-assembled filaments in the coagulation medium; wherein: the coagulation medium comprises at least one of (i) an acid as the at least one proton donor, and (ii) an aprotic solvent as the non-solvent for the aromatic polyamide nanofibers (e.g., the coagulation medium comprises one or both of the acid and the aprotic solvent). The method can further comprise one or more of: washing the wet nanofiber-assembled filaments; drawing the wet nanofiber-assembled filaments, thereby reducing or removing voids in the nanofiber-assembled filaments; drying the wet nanofiber-assembled filaments, thereby forming dry nanofiber-assembled filaments; and/or annealing the dry nanofiber-assembled filaments, thereby forming annealed nanofiber-assembled filaments.

In another aspect, the disclosure relates to a method for forming nanofiber-assembled composite filaments, the method comprising: providing a nanofiber suspension comprising (i) aromatic polyamide nanofibers dispersed therein, and (ii) an additional polymeric material dissolved or dispersed in the suspension; and wet-spinning the nanofiber suspension into a coagulation medium comprising at least one non-solvent for the aromatic polyamide nanofibers and optionally at least one proton donor, thereby forming wet nanofiber-assembled composite filaments in the coagulation medium. In a refinement, the additional polymeric material comprises cellulose nanofibers; and the coagulation medium further comprises a crosslinker. In a refinement, the additional polymeric material comprises polyamide-imide (PAI).

Wet-spinning generally includes extrusion of a solvent medium with polymer therein (e.g., dissolved therein) through a spinneret (or needle) submerged in a coagulation medium or bath composed of non-solvents. The coagulation bath causes the polymer to precipitate or otherwise assemble in fiber form. As described in more detail below, the non-solvent and proton donor in the coagulation medium can be the same or different materials, such as water (non-solvent and proton donor), acetone (non-solvent), hydrochloric acid (proton donor), and the coagulation medium can include one or more than one non-solvent as well as one or more than one proton donor. When performed, the optional washing step can include a deionized (DI) water rinse/wash to remove residual suspension medium components and coagulation medium components. When performed, the optional drying step can be performed during and/or after drawing of the filaments. When performed, the optional annealing step can include a high-temperature heat treatment to densify, strengthen, and/or stiffen the filaments.

Various refinements of the disclosed methods for forming nanofiber-assembled filaments and composite filaments are possible.

In a refinement, the aromatic polyamide of the nanofibers is selected from the group consisting of aromatic polyamide homopolymers, polyamide copolymers, and combinations thereof, for example including polymeric blends of multiple polymers in the same nanofiber and/or mixtures of nanofibers formed from different polymers. In embodiments, the aromatic polyamide homopolymer can include a single type of aromatic amide unit, for example resulting from polymerization of an aromatic monoamine/monoacid or halide thereof. In embodiments, the aromatic polyamide copolymer can include two or more types of aromatic amide units, but no other non-aromatic amide units, for example resulting from copolymerization of an aromatic diamine and aromatic diacid or halide thereof. In embodiments, the aromatic polyamide copolymer can include at least one type of aromatic amide units, and at least one type of other non-aromatic amide units. Examples of some commercially available aromatic polyamide copolymers include TERLON, SVM, and ARMOS copolymers, which can include amidebenzimidazole units, for example in addition to p-phenylene diamide units.

In an alternative aspect of the disclosed method, the initial nanofiber suspension can contain nanofibers other than or in addition to the aromatic polyamide nanofibers. For example, nanofibers including polymers having —(C═O) NH— units (or aromatic —(C═O) NH— units more specifically) along the backbone can provide a nitrogen atom for protonation during the wet-spinning process. Similarly, one or more nanofibers including polymers such as aliphatic polyamides, aliphatic/aromatic copolyamides, aromatic and/or aliphatic polyureas, or aromatic and/or aliphatic polyurethanes can be used in addition to or in place of the aromatic polyamide nanofibers in the general disclosed method above.

In a refinement, the aramid nanofiber comprises aromatic polyamide repeat units selected from —(NH—$C_6H_4$—NHCO—$C_6H_4$—CO)$_n$— (e.g., resulting from copolymerization of an aromatic diamine and aromatic diacid or halide thereof), —(NH—$C_6H_4$—CO)$_n$— (e.g., resulting from polymerization of an aromatic monoamine/monoacid or halide thereof), and combinations thereof. Examples can include p-phenylene terephthalamides (PPTAs) having para-linkages along the backbone resulting from copolymerization of p-phenylene diamine and terephthaloyl dichloride (e.g., commercially available as KEVLAR), poly-metaphenylene isophthalamides (MPIAs) having meta-linkages along the backbone resulting from copolymerization of m-phenylene diamine and isophthaloyl dichloride (e.g., commercially available as NOMEX).

In a refinement, the aramid nanofibers have a diameter in a range of 1 nm to 500 nm (e.g., 1 nm to 30 nm or 4 nm to 12 nm); and/or the aramid nanofibers have a length in a range of 0.5 μm to 250 μm (e.g., 1 μm to 50 μm or 2 μm to 20 μm). More generally, the aramid nanofibers can have a diameter of at least 1, 1.5, 2, 3, 4, 5, 6, 8, 10, 20, 30, or 50 nm and/or up to 8, 12, 15, 20, 30, 40, 50, 70, 100, 200, 300, or 500 nm. More generally, the aramid nanofibers can have a length of at least 0.5, 1, 1.5, 2, 3, 4, 5, 6, 8, 10, 20, or 30 μm and/or up to 8, 12, 15, 20, 30, 40, 50, 70, 100, 150, 200, or 250 μm. The size ranges can reflect a range encompassing the average diameter or length of a distribution of fibers, for example representing a number-, weight-, area-, or volume-average size of the size distribution. Alternatively or additionally, the size range can represent the lower and upper boundaries of a size distribution for the nanofibers, for example representing 1/99%, 2/98%, 5/95%, or 10/90% cut sizes of a cumulative size distribution.

In a refinement, the nanofiber suspension contains the aromatic polyamide nanofibers in an amount of 0.001 wt. % to 5 wt. % (or 0.2 wt. % to 1.5 wt. %) based on the nanofiber suspension; and the nanofiber suspension comprises a suspension medium comprising (optionally) water, a water-miscible solvent (e.g., DMSO) for the aromatic polyamide nanofibers, and a base (e.g., KOH). More generally, the nanofiber suspension can contain at least 0.001, 0.01, 0.02, 0.05, 0.1, 0.15, 0.2, 0.25, or 0.3 wt. % and/or up to 1, 1.2, 1.5, 2, 2.5, 3, 4, or 5 wt. % nanofibers (e.g., one or more different types of nanofibers combined) based on the nanofiber suspension. In some embodiments, the water can be omitted from the suspension medium. In some embodiments, the water-miscible solvent can include one or more of dimethyl sulfoxide (DMSO), dimethylacetamide (DMA or DMAc), dimethylformamide (DMF), N-methyl-2-pyrrolidone (NMP), methyl ethyl ketone (MEK), other ketones, etc. The base in not particularly limited, but it suitably includes an alkali metal hydroxide such as potassium hydroxide. In some embodiments, base materials such as lithium hydroxide and/or sodium hydroxide can be used to change or otherwise control the diameter/length of the filaments. In some embodiments, the nanofiber suspension can include one or more filler or reinforcement materials for incorporation into the final nanofiber-assembled filaments (e.g., as a composite structure with the aromatic polyamide), for example one or more of exfoliated clays, nanowires, carbon nanotubes, cellulose nanofibers, and nanocrystals.

In a refinement, the coagulation medium comprises water as the at least one non-solvent and the at least one proton donor (e.g., water serves both functions in the coagulation medium). In embodiments, water can be a primary or substantially the only liquid component of the coagulation medium, for example being present in an amount of 30 wt. % to 100 wt. % (e.g., at least 30, 40, 50, 60, 70 or 80 wt. % and/or up to 70, 85 or 100 wt. %) of the coagulation medium (i.e., liquid fraction of coagulation bath, excluding solid filament precipitate or other solids). In some embodiments, other non-solvent proton donors can be used in addition to or instead of water, for example including methanol or other alcohols (e.g., weak acids in a Bronsted acid) and/or in the same relative amounts noted above for water. More generally, other non-solvents that do not function as proton donors, but which are miscible with DMSO or other miscible with DMSO or other nanofiber suspension solvent (e.g., acetone, THF, toluene, etc.) could be used as a medium (e.g., without any water present) with any other proton donors (e.g., strong acids), for example in the same relative amounts noted above for water.

In a refinement, the coagulation medium comprises an acid (e.g., HCl) as the at least one proton donor. In embodiments, the coagulation medium can include an acid component as a proton donor, for example in an aqueous solution with water as a combination non-solvent/proton donor. The acid can be any suitable inorganic acid (e.g., sulfuric acid, hydrochloric acid, nitric acid) or organic acid (e.g., acetic acid), for example being present in an amount of 0.001 wt. % to 5 wt. % or 0.1 wt. % to 1 wt. % relative to the coagulation medium and/or providing a pH value of the coagulation medium in a range of 1 to 7. Other suitable proton donors can include alcohols, phenols, and thiols. More generally, the proton donor can be present in an amount of at least 0.001, 0.01, 0.02, 0.05, 0.1, 0.15, 0.2, 0.25, or 0.3 wt. % and/or up to 0.2, 0.5, 1, 1.2, 1.5, 2, 2.5, 3, 4, or 5 wt. % relative to the coagulation medium. Alternatively or additionally, the coagulation medium can have a pH of at least 1, 2, 3, 4, or 5 and/or up to 3, 4, 5, 6, or 7. Inclusion of an acid component as a proton donor increases the rate of protonation and filament formation, but it increases the relative disorder of the nanofiber components of the filament due to rapid filament formation and relatively less time for nanofiber alignment during coagulation.

In a refinement, the coagulation medium comprises an aprotic solvent (e.g., acetone) as the non-solvent for the aramid nanofibers. In embodiments, the coagulation medium can include an aprotic solvent such as acetone that serves as a non-solvent for the aramid nanofibers, but which does not serve as a proton donor for protonation of the aramid nanofibers. Other suitable aprotic solvents can include THF, DMF, and/or acetonitrile. The aprotic solvent can be present in an amount of 0.001 wt. % to 99 wt. %, 1 wt. % to 60 wt. % or 10 wt. % to 50 wt. % relative to the coagulation medium, for example with the balance being water or other (protic) proton-donor non-solvents. More generally, the aprotic solvent can be present in an amount of at least 0.001, 0.01, 0.1, 1, 2, 5, 10, 15, 20, 25, 30, or 40 wt. % and/or up to 10, 20, 30, 40, 50, 60, 70, 80, 90, or 99 wt. % relative to the coagulation medium. Inclusion of an aprotic solvent decreases the rate of protonation and filament formation, but it increases the relative order of the nanofiber components of the filament due to slower filament formation and relatively more time for nanofiber alignment during coagulation. The amount and type of aprotic solvent can be selected in combination with the amount and type of acid or other proton donor to provide an overall/net desired rate of protonation.

In a refinement, the coagulation medium comprises at least one of a crosslinker, a reinforcement material, a binder, and a functional component. Crosslinkers and any additional reinforcement and functional components could be added in the coagulation medium. For example, calcium chloride can be added to a coagulation medium to induce ionic bonding among cellulose nanofiber (CNF) networks when CNFs are included in the suspension medium along with the aromatic polyamide nanofibers. More generally, crosslinking functional components such as acyl chloride, thionyl chloride, and conventional photocatalysts can be included in the coagulation medium to react as a crosslinker between amine and carboxylic groups, for example between free amino and/or carboxylic groups in the aromatic polyamide as well as possibly in an additive of filler in the filament. Suitable reinforcements or fillers as additives to the coagulation medium can include functional nanomaterials, including the exfoliated clays, nanowires, carbon nanotubes, cellulose nanofibers, and nanocrystals mentioned above as optional nanofiber suspension components, for example in addition to as an alternative to their inclusion in the initial nanofiber suspension. Such functional nanomaterials in the coagulation medium can diffuse into the nanofiber suspension and form networks among the aromatic polyamide nanofibers based on the van der Waals interaction and hydrogen bonding.

In a refinement, the method comprises washing the wet nanofiber-assembled filaments. A DI water rinse/wash is suitably performed to remove residual suspension medium components and coagulation medium components prior to cutting, drawing, and drying the nanofiber-assembled filaments.

In a refinement, drawing the wet nanofiber-assembled filaments comprises subjecting the wet nanofiber-assembled filaments to an extensional strain of at least 2%. More generally, the extensional strain during the drawing step can be at least 2, 4, 6, 8, 10, 12, 15, 20, 25 or 30% and/or up to 5, 7, 10, 15, 20, 25, 30, 40, or 50%. The extensional strain represents a relative increase in the filament length relative to its initial length prior to drawing. For example, drawing to an extensional strain of 20% represent a filament with a final length of 1.2 times its initial length. The specific value selected for extensional strain during drawing may vary depending on the diameter of the fiber, ambient humidity and temperature. Higher extensional strain values could increase the relative order of ANF in the final filament. With a relatively smaller needle diameter for wet spinning, the extensional strain value is generally selected to be smaller to avoid filament breakage of the relatively lower-diameter filaments. The drawing time is not particularly limited, but it is typically performed within about 10 seconds to avoid (excessive) drying of the filaments, which could otherwise result in filament breakage if too dry.

In a refinement, the method comprises drying the wet nanofiber-assembled filaments. Drying can be performed oven or vacuum oven at an elevated temperature, such as between 30-200° C. or 50-200° C. for 4-48 hr.

In a refinement, the method comprises comprising annealing the (dry or wet) nanofiber-assembled filaments. Annealing can be performed at an elevated temperature and/or pressure, such as in an autoclave reactor or convection oven, such as between 150-400° C. for 2-24 hr.

In a refinement, the nanofiber-assembled filaments have at least one of the following properties: a Young's modulus of at least 30 GPa; a tensile strength of at least 600 MPa; a toughness of at least 30 MJ/m$^3$ (or at least 70 or 110 MJ/m$^3$); and/or an orientation index of at least 0.3 (or at least 0.4). More generally, the Young's modulus can be at least 30, 35, 40, or 50 GPa and/or up to 50, 55, 60, 65, or 70 GPa. More generally, the tensile strength can be at least 600, 800, 1000, 1100, 1200, or 1300 MPa and/or up to 1000, 1200, 1400, 1450, or 1500 MPa. More generally, the toughness can be at least 30, 50, 70, 90 or 110 MJ/m$^3$ and/or up to 100, 120, 140, 142, 145, or 150 MJ/m$^3$. More generally, the orientation index can be at least 0.3, 0.4, or 0.5 and/or up to 0.45, 0.5, 0.55, 0.6, or 0.7. As generally understood in the art, the orientation index f is calculated by Herman's orientation function based on measured XRD data, and it is a commonly known method for evaluating nanofiber alignment.

In a refinement, the nanofiber-assembled filaments have a diameter in a range of 1 μm to 50 μm (or 4 μm to 20 μm). More generally, the nanofiber-assembled filaments can have a diameter of at least 1, 2, 3, 4, 5, 6, 7, 8, 10, 12, 15, or 20 μm and/or up to 5, 7, 9, 12, 15, 18, 20, 25, 30, 40, or 50 μm. The diameter of the resulting filaments can be controlled or adjusted based on the selection of coagulation medium components, inclusion of post-formation processing steps (e.g., annealing), source of initial suspension nanofibers (e.g., virgin or recycled aramid nanofibers), etc. For instance and as illustrated in the various working examples, ANF-based filaments formed according to the disclosure can have a variety of diameters, summarized as follows: ANF-Acetone (0.2 wt %): 5.81±0.55 μm; ANF-Water (0.2 wt %): 6.30±0.52 μm; ANF-HCl (0.2 wt %): 6.57±0.53 μm; ANF-Acetone (0.5 wt %): 12.48±0.57 μm; ANF-Acetone (1.0 wt %): 14.66±0.85 μm; ANF-Acetone (1.5 wt %): 17.61±0.36 μm; ANF-Annealing: 5.61±0.10 μm; ANF-Acetone (narrow needle): 5.52±0.18 μm; ANF-Recycling: 6.52±0.15 μm. The size ranges can reflect a range encompassing the average diameter of a distribution of filaments, for example representing a number-, weight-, area-, or volume-average size of the size distribution. Alternatively or additionally, the size range can represent the lower and upper boundaries of a size distribution for the filaments, for example representing 1/99%, 2/98%, 5/95%, or 10/90% cut sizes of a cumulative size distribution.

In a refinement, the filaments are formed in the absence of binders and/or crosslinkers, for example where one or more of the colloidal suspension, coagulation bath, and final filament are free from binders and/or crosslinkers. In general, there is no change in chemical structure occurring during dissolution, spinning, and drawing, so the polymer materials in the final filaments are the same as those in the original nanofiber suspension. From the original fiber, nanofibers are isolated via deprotonation into suspension. Then, the deprotonated nanofibers are assembled via protonation to final filaments. The deprotonation and protonation process does not ultimately change the chemical structure for the aromatic polyamide polymer components that make up the original source nanofibers and final nanofiber-assembled filaments. For example, the final filaments can contain not more than 0.01, 0.1, 0.2, 0.5, 1, 2, or 5 wt. % of binders, crosslinkers, and/or materials other than the polymer materials (e.g., aromatic polyamide nanofibers) of the original nanofiber suspension. In some alternative refinements, the filaments can be formed in the presence of a binders and/or crosslinker, for example where one or more of the colloidal suspension, coagulation bath, and the final filaments contain a binder and/or crosslinker (e.g., at least 0.01, 0.1, 0.2, 0.5, 1, 2, or 5 wt. % and/or up to 1, 2, 4, 8, 12, 16, 20, or 30 wt. % on a weight basis relative to the final filament).

In another aspect, the disclosure relates to nanofiber-assembled filaments formed according to the disclosed method in any of its various refinements, embodiments, etc.

In another aspect, the disclosure relates to a method for recycling aramid fibers, the method comprising: forming a (colloidal) nanofiber suspension from one or more of an aramid fiber, fabric, or filament material, converting the aramid fiber, fabric, or filament material to aramid nanofibers dispersed in a nanofiber suspension medium (e.g., DMSO, water, KOH medium to which the aramid material to be recycled is added); and performing the disclosed method in any of it various refinements, embodiments, etc. on the nanofiber suspension to form (recycled) nanofiber-assembled filaments.

In another aspect, the disclosure relates to a method of additive manufacturing (or 3D printing) using the nanofiber-assembled filaments as individual component elements to assemble and build into a final composite structure having a predetermined, three-dimensional structure other than a filament structure. For example, the disclosed method for forming nanofiber-assembled filaments can be repeated any number of times as desired to form a plurality of nanofiber-assembled filaments, and the individual filaments can then be assembled into the final additive manufacturing structure in which the individual filaments are the building elements of the final composite structure.

While the disclosed articles, compositions, and methods are susceptible of embodiments in various forms, specific embodiments of the disclosure are illustrated (and will hereafter be described) with the understanding that the disclosure is intended to be illustrative, and is not intended to limit the claims to the specific embodiments described and illustrated herein.

DETAILED DESCRIPTION

Aromatic polyamide nanofibers, such as aramid nanofibers (ANFs), are a type of organic nanoscale building block created from the disassembly of macroscale fibers through a deprotonation and dissolution process. Such nanofibers can be used in various applications due to their high mechanical strength, stiffness, toughness, and thermal stability. Existing methods for assembling of nanoscale fibers into macroscale structures, however, do not generally provide macroscale structures with the favorable mechanical properties of the corresponding nanoscale fibers. Thus, to translate the exceptional properties of nanomaterials to macroscale structure, there is a need for nanomaterial-oriented manufacturing strategies that promote the precise and defect-free bridging of the nanoscale geometry to the macroscale. Accordingly, the disclosure provides processing methodologies that can organize ANFs (or aromatic polyamide nanofibers more generally) into hierarchically ordered aramid filaments using a scalable wet-spinning process that simultaneously achieves protonation and assembly of the ANFs. The ANF-assembled filaments exhibit excellent mechanical properties comparable to synthetic and natural fibers such as natural silk, nanocellulose, nylon, and fibers made of carbon nanotubes. By implementing a bottom-up reorganization of ANF networks into macroscale filaments, the resulting process provides high-performance macroscale crystalline solids that emulate and exceed the mechanical properties of hierarchical biological materials for a wide range of structural applications.

Figure 1:
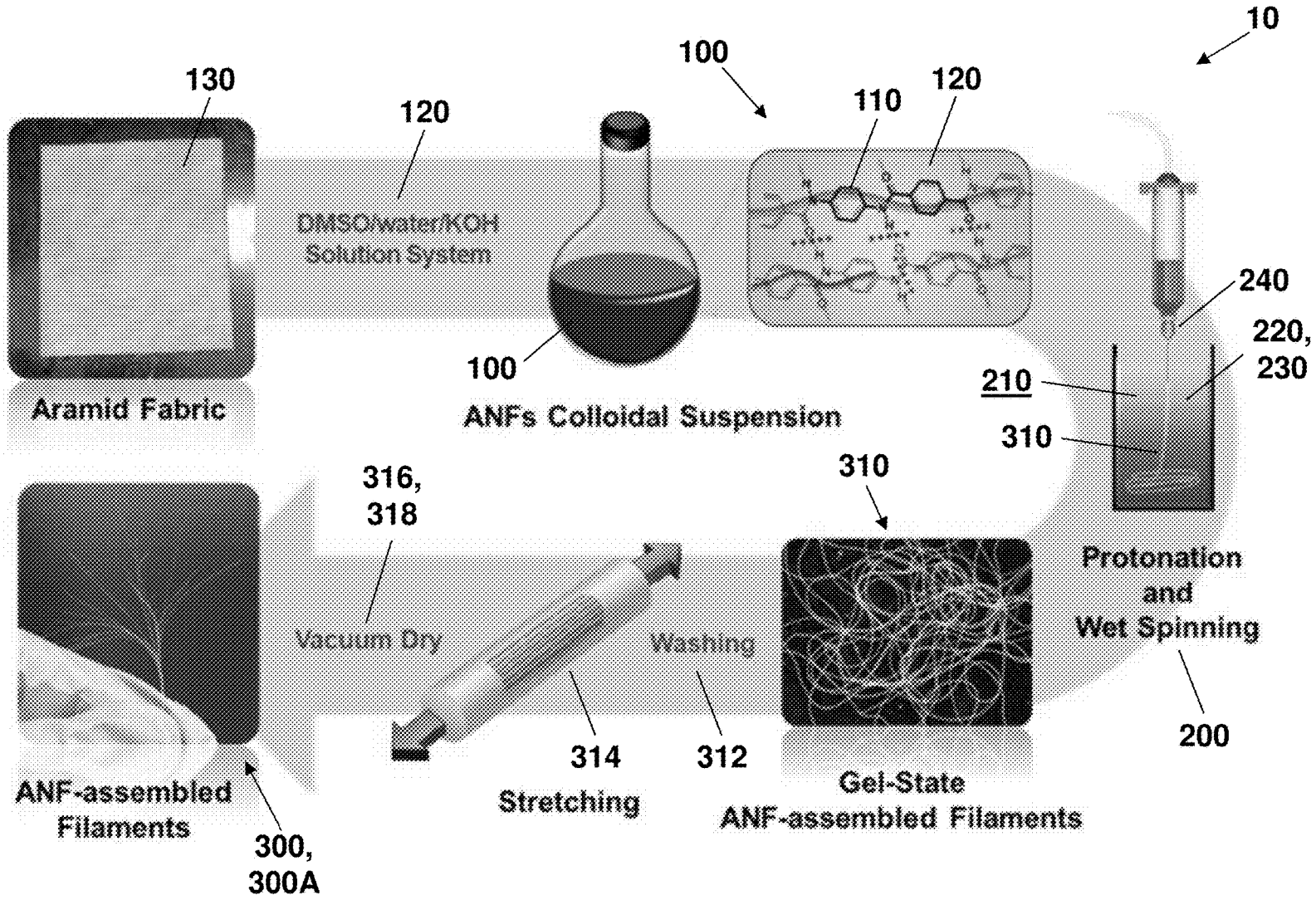
FIG. 1 is a flowchart schematic of a fabrication process for ANF-assembled filaments according to the disclosure.
Figure 2:
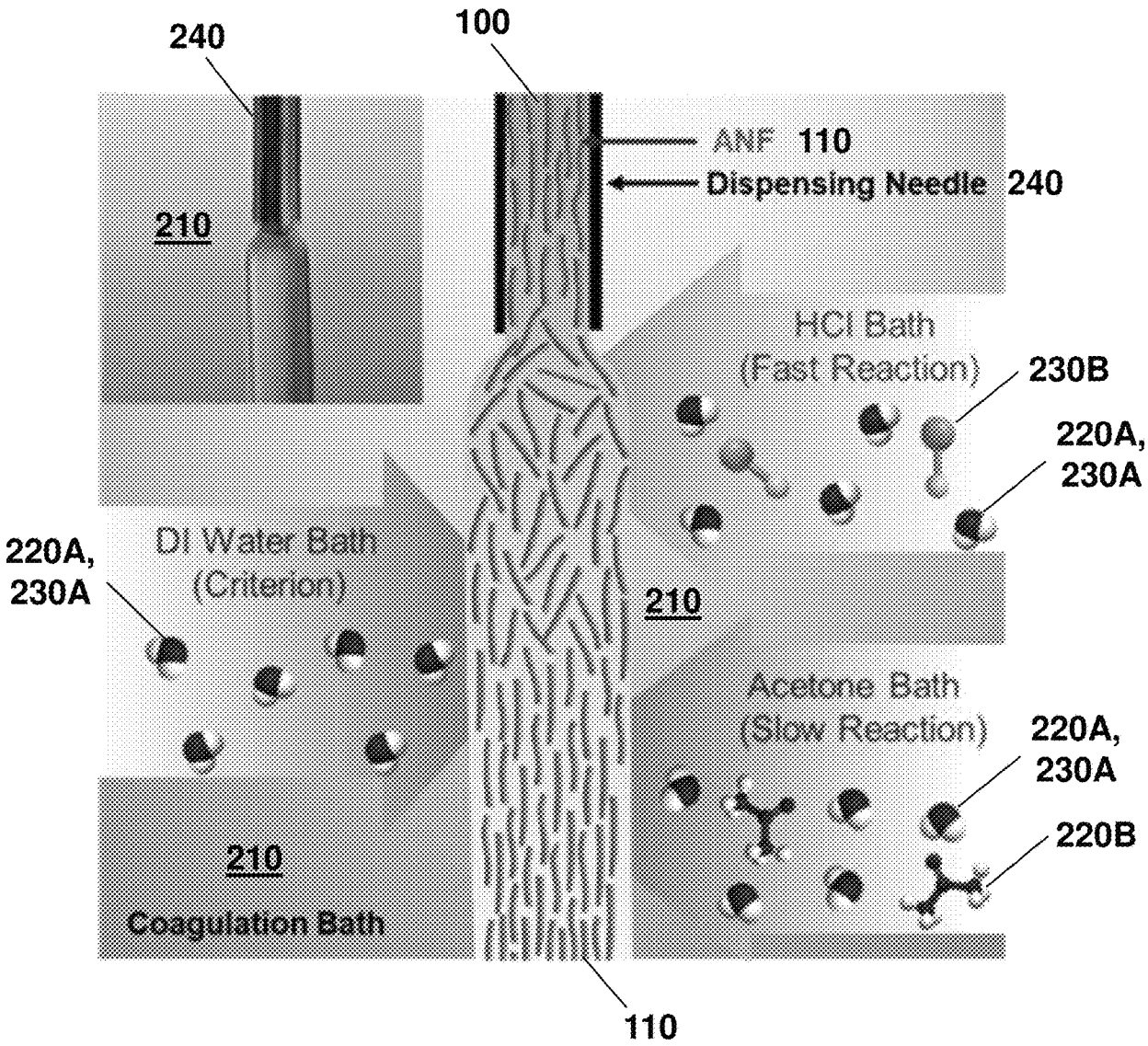
FIG. 2 is a schematic illustrating ANF assembly based on the relationship between the orientation of ANFs and protonation rate difference in different coagulation baths according to the disclosure.

FIG. 1 and FIG. 2 illustrate a method 10 for forming nanofiber-assembled filaments 300 according to the disclosure. An aromatic polyamide nanofiber suspension 100 is first formed into wet nanofiber-assembled filaments 310 via protonation and wet-spinning 200 in a coagulation medium 210 including at least one proton donor 220 along with a non-solvent 230 for aromatic polyamide nanofibers 110 in the suspension 100. The wet nanofiber-assembled filaments 310 can then be processed by one or more subsequent steps, including a washing step 312, a drawing or stretching step 314 to reduce/remove voids in the nanofiber-assembled filaments 310, a drying step 316 to remove suspension solvent, coagulation bath, and/or wash liquid components from the wet nanofiber-assembled filaments 310 to form dry nanofiber-assembled filaments 300, and an annealing step performed on the dry nanofiber-assembled filaments 300 to form annealed nanofiber-assembled filaments 300A. The drawing or stretching step 314 can improve the mechanical properties of the final assembled filaments 300 (or 300A). The method 10 also can be used as a recycling method for used aromatic polyamide fiber/filament materials in which the recycled filaments have high/good mechanical properties relative to virgin filament materials.

The suspension 100 generally includes one or more types of nanofibers 110, for example aromatic polyamide nanofibers 110, in a suspension medium 120. Suitable amounts for the nanofibers 110 in the suspension can be 0.001 wt. % to 5 wt. % or 0.2 wt. % to 1.5 wt. %, for example at least 0.001, 0.01, 0.02, 0.05, 0.1, 0.15, 0.2, 0.25, or 0.3 wt. % and/or up to 1, 1.2, 1.5, 2, 2.5, 3, 4, or 5 wt. % nanofibers (e.g., one or more different types of nanofibers combined) based on the nanofiber suspension. In embodiments, the suspension medium 120 can include one or more of water, a water-miscible solvent (e.g., DMSO) for the aromatic polyamide nanofibers 110, and a base (e.g., KOH). In some embodiments, the water can be omitted from the suspension medium. In some embodiments, the water-miscible solvent can include one or more of dimethyl sulfoxide (DMSO), dimethylacetamide (DMA or DMAc), dimethylformamide (DMF), N-methyl-2-pyrrolidone (NMP), methyl ethyl ketone (MEK), other ketones, etc. The base in not particularly limited, but it suitably includes an alkali metal hydroxide such as potassium hydroxide, also other base materials such as lithium hydroxide and/or sodium hydroxide can be used to change or otherwise control the diameter/length of the filaments. The combined amount of water, water-miscible solvent(s), and base in the suspension medium 120 can be 95 wt. % to 99.999 wt. % or 98.5 wt. % to 99.2 wt. %, for example at least 95, 96, 97, 98, or 99 wt. % and/or up to 97, 98, 98.5, 99, 99.5, 99.9, 99.99, or 99.999 wt. % based on the nanofiber suspension.

The aromatic polyamide or aramid polymer forming the nanofibers 110 can include one or more aromatic polyamide homopolymers, for example with only aromatic amide repeat units. Alternatively or additionally, the aromatic polyamide or aramid polymer can include one or more aromatic polyamide copolymers, for example with aromatic amide repeat units and other repeat units (e.g., non-aromatic amide units). The nanofibers can include polymeric blends of multiple polymers in the same nanofiber and/or mixtures of nanofibers formed from different polymers. The aromatic polyamide homopolymer can include a single type of aromatic amide unit, for example resulting from polymerization of an aromatic monoamine/monoacid or halide thereof. The aromatic polyamide copolymer can include two or more types of aromatic amide units, but no other non-aromatic amide units, for example resulting from copolymerization of an aromatic diamine and aromatic diacid or halide thereof. In embodiments, the aromatic polyamide copolymer can include at least one type of aromatic amide units, and at least one type of other non-aromatic amide units. Examples of some commercially available aromatic polyamide copolymers include TERLON, SVM, and ARMOS copolymers, which can include amidebenzimidazole units, for example in addition to p-phenylene diamide units.

In embodiments, the aromatic polyamide or aramid polymer forming the nanofibers 110 include one or both of aromatic polyamide repeat units represented by formula (A) or formula (B):

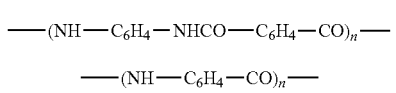

$$\text{—(NH—C}_6\text{H}_4\text{—NHCO—C}_6\text{H}_4\text{—CO)}_n\text{—} \quad (A)$$

$$\text{—(NH—C}_6\text{H}_4\text{—CO)}_n\text{—} \quad (B)$$

The structure of formula (A) can result from copolymerization of an aromatic diamine and aromatic diacid or halide thereof. The structure of formula (B) can result from polymerization of an aromatic monoamine/monoacid or halide thereof. Examples can include p-phenylene terephthalamides (PPTAs) having para-linkages along the backbone resulting from copolymerization of p-phenylene diamine and terephthaloyl dichloride (e.g., commercially available as KEVLAR), poly-metaphenylene isophthalamides (MPIAs) having meta-linkages along the backbone resulting from copolymerization of m-phenylene diamine and isophthaloyl dichloride (e.g., commercially available as NOMEX).

In some alternative embodiments, the initial nanofiber suspension 100 can contain nanofibers other than or in addition to the aromatic polyamide nanofibers 110. For example, nanofibers including polymers having —(C═O)NH— units (or aromatic —(C═O)NH— units more specifically) along the backbone can provide a nitrogen atom for protonation during the wet-spinning process. Similarly, one or more nanofibers including polymers such as aliphatic polyamides, aliphatic/aromatic copolyamides, aromatic and/or aliphatic polyureas, or aromatic and/or aliphatic polyurethanes can be used in addition to or in place of the aromatic polyamide nanofibers in the general method disclosed herein.

The aramid nanofibers 110 typically have nanoscale diameters and/or microscale lengths. For example the aramid nanofibers can have a diameter in a range of 1 nm to 500 nm, 1 nm to 30 nm, or 4 nm to 12 nm, such as a diameter of at least 1, 1.5, 2, 3, 4, 5, 6, 8, 10, 20, 30, or 50 nm and/or up to 8, 12, 15, 20, 30, 40, 50, 70, 100, 200, 300, or 500 nm. Alternatively or additionally, the aramid nanofibers can have a length in a range of 0.5 μm to 250 μm, 1 μm to 50 μm, or 2 μm to 20 μm, such as a length of at least 0.5, 1, 1.5, 2, 3, 4, 5, 6, 8, 10, 20, or 30 μm and/or up to 8, 12, 15, 20, 30, 40, 50, 70, 100, 150, 200, or 250 μm. The size ranges can reflect a range encompassing the average diameter or length of a distribution of fibers, for example representing a number-, weight-, area-, or volume-average size of the size distribution. Alternatively or additionally, the size range can represent the lower and upper boundaries of a size distribution for the nanofibers, for example representing 1/99%, 2/98%, 5/95%, or 10/90% cut sizes of a cumulative size distribution. The foregoing sizes and ranges can similarly apply to other nanofiber materials in the suspension 100.

In some embodiments, the nanofiber suspension can include one or more filler, reinforcement, and/or polymeric materials for incorporation into the final nanofiber-assembled filaments, for example as a composite structure with the aromatic polyamide. The composite structure can include two (heterogeneous) particulate phases compounded together, aromatic polyamide nanofibers compounded with other nanofibers, nanotubes, nanoplatelets, etc. to form the corresponding nanofilaments. Alternatively the composite structure can include a polymeric material or other (continuous) matrix throughout which aromatic polyamide nanofibers and/or assembled nanofilaments are distributed. Examples of additional materials in the nanofiber suspension include one or more of exfoliated clays, nanowires, carbon nanotubes, cellulose nanofibers, nanocrystals, and/or polymers such as polyamide-imide (PAI). The additional filler, reinforcement, and/or polymeric materials can be included in the nanofiber suspension in any suitable amount relative to the aromatic polyamide nanofibers, for example containing 10-90 wt. %, 10-50 wt. %, or 50-90 wt. % of additional materials relative to the total solid content of the suspension (e.g., including aromatic polyamide nanofibers and additional solid materials remaining in the final filaments, but not liquid suspension components). Similarly, the suspension can contain 10-90 wt. %, 10-50 wt. %, or 50-90 wt. % of aromatic polyamide nanofibers relative to the total solid content of the suspension.

Wet-spinning generally includes extrusion or injection of a solvent medium with polymer therein (e.g., dissolved therein) through a spinneret (or needle) submerged in a coagulation medium or bath composed of non-solvents, whereupon the coagulation bath causes the polymer to precipitate or otherwise assemble in fiber form. As illustrated in FIG. 1 and FIG. 2, the disclosed method 10 includes a protonation and wet spinning step 200 in which the nanofiber suspension 100 is injected into a coagulation medium or bath 210 containing at least one non-solvent 220 for the nanofibers 110 and at least one proton donor 230. The non-solvent 220 is generally a solvent in which the nanofibers 110 have very little or essentially no solubility, thus promoting precipitation and fiber or filament formation in the bath 210. The proton donor 230 can be any component that provides a proton ($H^+$) in the coagulation bath 210, which can protonate and precipitate the nanofibers 110 from the suspension 100 to form wet nanofiber-assembled filaments 310. The proton donor 230 can be a component that provides its proton via ionic dissolution (e.g., from a strong acid or other ionic species) or via equilibrium dissolution (e.g., equilibrium dissociation of water, a weak acid, etc.). The non-solvent 230 and the proton donor 230 in the coagulation bath 210 can be the same or different materials, such as water (non-solvent and proton donor), acetone (non-solvent), hydrochloric acid (proton donor), and the coagulation bath 210 can include one or more than one non-solvent 220 as well as one or more than one proton donor 230. For example, as illustrated in FIG. 2, a DI water bath as the coagulation bath 210 can include water molecules as the only (or first) non-solvent 220A and the only (or first) proton donor 230A. As similarly illustrated, an HCl (or acid) bath as the coagulation bath 210 can include water molecules as the first non-solvent 220A and proton donor 230A as well as HCl (or acid) as a second proton donor 230B. Likewise, an acetone (or aprotic non-solvent) bath as the coagulation bath 210 can include water molecules as the first non-solvent 220A and proton donor 230A as well as acetone (or aprotic non-solvent) as a second non-solvent 220B.

In embodiments and as noted above, the coagulation medium or bath 210 can include water as the at least one non-solvent 220 and the at least one proton donor 230 such that water serves both functions in the coagulation medium 210. In embodiments, water can be a primary or substantially the only liquid component of the coagulation medium 210, for example being present in an amount of 30 wt. % to 100 wt. % (e.g., at least 30, 40, 50, 60, 70 or 80 wt. % and/or up to 70, 85 or 100 wt. %) of the coagulation medium (i.e., liquid fraction of coagulation bath, excluding solid filament precipitate or other solids). In some embodiments, other non-solvent proton donors can be used in addition to or instead of water, for example including methanol or other alcohols (e.g., weak acids in a Bronsted acid) and/or in the same relative amounts noted above for water. More generally, other non-solvents that do not function as proton donors, but which are miscible with dimethyl sulfoxide (DMSO) or other miscible with DMSO or other nanofiber suspension solvent (e.g., acetone, tetrahydrofuran, toluene, etc.) could be used as a medium (e.g., without any water present) with any other proton donors (e.g., strong acids), for example in the same relative amounts noted above for water.

In embodiments and as noted above, the coagulation medium or bath 210 can include an acid (e.g., hydrochloric acid) as the at least one proton donor 230. In embodiments, the coagulation medium 210 can include an acid component as a proton donor, for example in an aqueous solution with water as a combination non-solvent/proton donor. The acid can be any suitable inorganic acid (e.g., sulfuric acid, hydrochloric acid, nitric acid) or organic acid (e.g., acetic acid), for example being present in an amount of 0.001 wt. % to 5 wt. % or 0.1 wt. % to 1 wt. % relative to the coagulation medium and/or providing a pH value of the coagulation medium in a range of 1 to 7. Other suitable proton donors can include alcohols, phenols, and thiols. More generally, the proton donor can be present in an amount of at least 0.001, 0.01, 0.02, 0.05, 0.1, 0.15, 0.2, 0.25, or 0.3 wt. % and/or up to 0.2, 0.5, 1, 1.2, 1.5, 2, 2.5, 3, 4, or 5 wt. % relative to the coagulation medium. Alternatively or additionally, the coagulation medium can have a pH of at least 1, 2, 3, 4, or 5 and/or up to 3, 4, 5, 6, or 7. Inclusion of an acid component as a proton donor increases the rate of protonation and filament formation, but it also increases the relative disorder of the nanofiber components of the filament due to rapid filament formation and relatively less time for nanofiber alignment during coagulation.

In embodiments and as noted above, the coagulation medium or bath 210 can include an aprotic solvent (e.g., acetone) as the non-solvent 220 for the aramid nanofibers 110. In embodiments, the coagulation medium 210 can include an aprotic solvent such as acetone that serves as a non-solvent for the aramid nanofibers 110, but which does not serve as a proton donor for protonation of the aramid nanofibers 110. Other suitable aprotic solvents can include tetrahydrofuran (THF), dimethylformamide (DMF), and/or acetonitrile. The aprotic solvent can be present in an amount of 0.001 wt. % to 99 wt. %, 1 wt. % to 60 wt. % or 10 wt. % to 50 wt. % relative to the coagulation medium, for example with the balance being water or other (protic) proton-donor non-solvents. More generally, the aprotic solvent can be present in an amount of at least 0.001, 0.01, 0.1, 1, 2, 5, 10, 15, 20, 25, 30, or 40 wt. % and/or up to 10, 20, 30, 40, 50, 60, 70, 80, 90, or 99 wt. % relative to the coagulation medium. Inclusion of an aprotic solvent decreases the rate of protonation and filament formation, but it increases the relative order of the nanofiber components of the filament due to slower filament formation and relatively more time for nanofiber alignment during coagulation. The amount and type of aprotic solvent can be selected in combination with the amount and type of acid or other proton donor to provide an overall/net desired rate of protonation.

In some embodiments, the coagulation medium or bath 210 can include one or more further components in addition to the non-solvent 220 and the proton donor 230. Examples of such further components can include crosslinkers, reinforcement materials, binders, and other functional components. Crosslinkers and any additional reinforcement and functional components could be added in the coagulation medium 210. For example, calcium chloride can be added to a coagulation medium 210 to induce ionic bonding among cellulose nanofiber (CNF) networks when CNFs are included in the suspension medium 100 along with the aromatic polyamide nanofibers 110. More generally, crosslinking functional components such as acyl chloride, thionyl chloride, and conventional photocatalysts can be included in the coagulation medium 210 to react as a crosslinker between amine and carboxylic groups, for example between free amino and/or carboxylic groups in the aromatic polyamide as well as possibly in an additive or filler in the assembled filament 300. Suitable reinforcements or fillers as additives to the coagulation medium 210 can include functional nanomaterials, including the exfoliated clays, nanowires, carbon nanotubes, cellulose nanofibers, and nanocrystals mentioned above as optional nanofiber suspension 100 components, for example in addition to as an alternative to their inclusion in the initial nanofiber suspension 100. Such functional nanomaterials in the coagulation medium 210 can diffuse into the nanofiber suspension 100 and form networks among the aromatic polyamide nanofibers 110 based on van der Waals interactions and hydrogen bonding.

In some embodiments, the method 10 includes a washing step 312 for the wet nanofiber-assembled filaments 310. A deionized (DI) water rinse/wash is suitably performed to remove residual suspension medium 100 components and coagulation medium 210 components from the wet filaments 310 prior to any downstream process steps (e.g., cutting, drawing, drying, and/or annealing.

Although not required depending on the intended end use of the nanofiber-assembled filaments 300, the method 10 suitably includes a drawing or stretching step 314. The drawing or stretching step 314 can reduce and/or remove voids in the wet nanofiber-assembled filaments 310 to improve the mechanical properties of the final dried assembled filaments 300 (or annealed assembled filaments 300A). The drawing or stretching step 314 generally includes subjecting the wet nanofiber-assembled filaments 310 to a controlled or a preselected extensional strain or elongation, for example an extensional strain of at least 2%. More generally, the extensional strain during the drawing step can be at least 2, 4, 6, 8, 10, 12, 15, 20, 25 or 30% and/or up to 5, 7, 10, 15, 20, 25, 30, 40, or 50%. The extensional strain represents a relative increase in the filament length relative to its initial length prior to drawing. For example, drawing to an extensional strain of 20% represent a filament with a final length of 1.2 times its initial length. The specific value selected for extensional strain during drawing may vary depending on the diameter of the fiber, ambient humidity and temperature. Higher extensional strain values could increase the relative order of ANF in the final filament. With a relatively smaller needle diameter for wet spinning, the extensional strain value is generally selected to be smaller to avoid filament breakage of the relatively lower-diameter filaments. In embodiments, the inner diameter of the needle 240 used for wet-spinning can be about 25-500 μm or about 100-150 μm, for example at least 25, 50, 75, 100, or 125 μm and/or up to 100, 125, 150, 200, 250, 300, 400, or 500 μm The drawing time is not particularly limited, but it is typically performed within about 10 seconds to avoid (excessive) drying of the filaments, which could otherwise result in filament breakage if too dry.

In some embodiments, the method 10 includes a drying step 316. When performed, the optional drying step 316 can be performed during and/or after drawing or stretching 314 of the wet filaments 310. Drying can be performed oven or vacuum oven at an elevated temperature, such as between 30-200° C. or 50-200° C. for 4-48 hr.

In some embodiments, the method 10 includes an annealing step 318. When performed, the optional annealing step 318 can include a high-temperature heat treatment to densify, strengthen, and/or stiffen the dry filaments 300. Annealing can be performed at an elevated temperature and/or pressure, such as in an autoclave reactor or convection oven, such as between 150-400° C. for 2-24 hr.

The disclosed method 10 is capable of fabricating nanofiber-assembled filaments 300 having favorable mechanical and physical properties, in particular relative to their aromatic polyamide nanofiber 110 precursors. The specific filament 300 properties can be controlled or selected over relatively wide ranges based on specific process conditions, for example including one or more of nanofiber 110 concentration in the suspension 100, specific selection and concentration of coagulation bath 210 components, diameter of the injection needle 240 used for wet spinning, etc. Examples of suitable threshold values that can be desirable in various cases include one or more of a Young's modulus of at least 30 GPa (or at least 40 or 50 GPa); a tensile strength of at least 600 MPa (or at least 1200 or 1300 MPa); a toughness of at least 30 $MJ/m^3$ (or at least 70 or 110 $MJ/m^3$); and/or an orientation index of at least 0.3 (or at least 0.4). More generally, the Young's modulus can be at least 30, 35, 40, or 50 GPa and/or up to 50, 55, 60, 65, or 70 GPa. More generally, the tensile strength can be at least 600, 800, 1000, 1100, 1200, or 1300 MPa and/or up to 1000, 1200, 1400, 1450, or 1500 MPa. More generally, the toughness can be at least 30, 50, 70, 90 or 110 $MJ/m^3$ and/or up to 100, 120, 140, 142, 145, or 150 $MJ/m^3$. More generally, the orientation index can be at least 0.3, 0.4, or 0.5 and/or up to 0.45, 0.5, 0.55, 0.6, or 0.7. As generally understood in the art, the orientation index f is calculated by Herman's orientation function based on measured XRD data, and it is a commonly known method for evaluating nanofiber alignment.

In embodiments, the nanofiber-assembled filaments 300 can have a diameter in a range of 1 μm to 50 μm or 4 μm to 20 μm. More generally, the nanofiber-assembled filaments 300 can have a diameter of at least 1, 2, 3, 4, 5, 6, 7, 8, 10, 12, 15, or 20 μm and/or up to 5, 7, 9, 12, 15, 18, 20, 25, 30, 40, or 50 μm. The diameter of the resulting filaments 300 can be controlled or adjusted based on the selection of coagulation medium 210 components, diameter of the injection needle 240, inclusion of post-formation processing steps (e.g., annealing), source of initial suspension 100 nanofibers 110 (e.g., virgin or recycled aramid nanofibers), etc. The size ranges can reflect a range encompassing the average diameter of a distribution of filaments 300, for example representing a number-, weight-, area-, or volume-average size of the size distribution. Alternatively or additionally, the size range can represent the lower and upper boundaries of a size distribution for the filaments, for example representing 1/99%, 2/98%, 5/95%, or 10/90% cut sizes of a cumulative size distribution.

In embodiments, the filaments 300 are formed in the absence of binders and/or crosslinkers, for example where one or more of the colloidal suspension 100, coagulation bath 210, and final dry filaments 300 (or wet filaments 310) are free from binders and/or crosslinkers. In general, there is no change in chemical structure occurring during dissolution, spinning, and drawing, so the polymer materials in the final filaments 300 are the same as those in the original nanofiber suspension 100. From the original fiber (e.g., aramid fabric 130 as shown in FIG. 1), nanofibers 110 are isolated via deprotonation into suspension 100. Then, the deprotonated nanofibers 110 are assembled via protonation to wet filaments 310 and eventually to the final (dry) filaments 300. The deprotonation and protonation process does not ultimately change the chemical structure for the aromatic polyamide polymer components that make up the original source nanofibers 110 and final nanofiber-assembled filaments 300. For example, the final filaments 300 can contain not more than 0.01, 0.1, 0.2, 0.5, 1, 2, or 5 wt. % of binders, crosslinkers, and/or materials other than the polymer materials (e.g., aromatic polyamide nanofibers 110) of the original nanofiber suspension. In some alternative refinements, the filaments 300 can be formed in the presence of a binders and/or crosslinker, for example where one or more of the colloidal suspension, coagulation bath, and the final filaments 300 contain a binder and/or crosslinker (e.g., at least 0.01, 0.1, 0.2, 0.5, 1, 2, or 5 wt. % and/or up to 1, 2, 4, 8, 12, 16, 20, or 30 wt. % on a weight basis relative to the final filament).

EXAMPLES

The following examples illustrate the disclosed compositions, articles, and methods, but are not intended to be limiting.

Example 1—ANF Macroscale Filaments

This example illustrates the assembly of aramid nanofibers (ANFs) into macroscale filaments using a simultaneous protonation and wet-spinning process combined with subsequent drawing and annealing processes to reduce defects. The fabricated ANF-assembled filaments have ordered nanofibers that have high mechanical properties, including a Young's modulus of 53.15±8.98 GPa, tensile strength of 1,353.64±92.98 MPa, and toughness of 128.66±14.13 $MJ/m^3$. Compared to commercial aramid fibers, the formed filaments exhibit approximately 1.6 times greater toughness while also providing specific energy to break compared to existing synthetic fibers. Furthermore, the filaments can be recycled to yield approximately 94% of the mechanical properties of the initially fabricated filaments, therefore demonstrating the sustainability of the ANF-assembled filaments. This example thus illustrates a process to produce high stiffness and strength filaments composed of nanoscale building blocks which possess significantly greater toughness compared to the commercial KEVLAR fibers.

Materials: KM2+ aramid fabric (KEVLAR KM2+, style 790, CS-800) was obtained from JPS Composite Materials. Dimethyl sulfoxide (DMSO, ACS certified), potassium hydroxide (KOH, ACS certified), and hydrochloric acid (HCl, ACS certified) were purchased from Fisher Scientific. Acetone (ACS reagent) was purchased from Sigma-Aldrich, and Deionized (DI) water was collected from a purification system (PURELAB Ultra, ELGA LabWater).

Preparation of ANFs colloidal suspensions: Multiple ANF colloidal suspensions were prepared by preparing a mixture of 150 mL of DMSO and 6 mL of DI water, to which different ratios of aramid fabric and KOH were added at various concentrations (denoted as 0.2, 0.5, 1.0, and 1.5 wt. % as nominal ANF concentration), followed by stirring in the prepared solvent mixture for 3 days at room temperature. Table 1 below summarizes the suspension compositions for the four different ANF concentrations prepared.

TABLE 1

Prepared chemical composition of ANFs colloidal suspensions

| ANF Concentration | Aramid Fabric | DMSO | DI Water | KOH |
|---|---|---|---|---|
| 0.2 wt % | 0.3 g | 150 mL | 6 mL | 0.45 g |
| 0.5 wt % | 0.75 g | 150 mL | 6 mL | 0.6 g |
| 1 wt % | 1.5 g | 150 mL | 6 mL | 0.75 g |
| 1.5 wt % | 2.25 g | 150 mL | 6 mL | 1.125 g |

Fabrication of ANF-assembled filaments: The first step in fabricating the ANF-assembled filaments is producing gel-state filaments through wet spinning. The wet spinning process used in this example includes three steps: coagulation, washing, and stretching. At the coagulation step, the colloidal suspensions with varying concentration of ANFs were loaded into 10 mL syringes and extruded by a high precision fluid dispenser (ULTIMUS V, Nordson EFD) with a 72 cm/min spinning speed through a flat end stainless-steel needle with an inner diameter of 150 μm and a length of 50 mm into three different coagulant baths at ambient temperature (about 25° C. or about 20° C.-30° C.). The three different coagulation baths were selected to vary protonation rate and were prepared with (1) 30 wt % acetone in DI water, (2) DI water alone, and (3) a 0.05 M HCl aqueous solution in DI water. Gel-state filaments were spun into the coagulation bath and allowed to sit in the bath for 15 min. The gel-state filaments were then dredged from the coagulation bath, then twice immersed in clean DI water baths. The protonated filaments were then cut to 10 cm long sections that were then stretched (or drawn) using a manual translation stage by 120%. Finally, the filaments were collected, hung on a drying rack, and dried in a vacuum oven at 140° C. for 24 hours to remove residual solvent. For an additional annealing process, the vacuum-dried filaments were placed in a 125 mL stainless-steel autoclave reactor (Model 4748, Parr Instrument Company) and heated in a convection oven (HERATHERM OMH60, Thermo Scientific) to 300° C. at 5° C./min before holding for 5 hours.

Morphological and chemical characteristics: The isolated ANFs were redispersed in DI water after vacuum filtration with acetone and DI water for washing and drop cast on the oxygen plasma treated silicon wafer. The isolated ANFs were then inspected by atomic force microscopy (AFM, XE-70, Park Systems). The cross-section area, surface, and knot of fabricated ANF-assembled filaments were characterized and imaged through a scanning electron microscope (SEM, JSM-7800FLV, JEOL). The elements in the fabricated filaments were analyzed by energy-dispersive X-ray spectroscopy (EDS) equipped in the SEM.

The chemical composition of the commercial aramid fiber and the ANF-assembled filaments were studied using Fourier transform infrared spectroscopy (FTIR, Nicolet is 50 spectrometer, Thermo Scientific) with a SMART ITR accessory ranging from 650 $cm^{-1}$ to 4000 $cm^{-1}$ at a resolution of 0.4 $cm^{-1}$. The crystal structures of the prepared specimens were analyzed by using an X-ray diffractometer (XRD, Ultima IV, Rigaku) with a Cu Kα radiation source (λ=0.154 nm). Moreover, azimuthal angle scanning was conducted using the same instrument at the 2θ=22.8°, which corresponds to the (200) crystal planes, to estimate crystalline alignment in the fabricated filaments. The alignment of ANFs was quantified by Herman's orientation function (f), which is defined as:

$$f = \frac{3}{2}\cos^2\varnothing - \frac{1}{2} \quad \text{(I)}$$

$$\cos^2\varnothing = \frac{\int_0^{\pi/2} I(\varnothing)\cos^2(\varnothing)\sin(\varnothing)d\varnothing}{\int_0^{\pi/2} I(\varnothing)\sin(\varnothing)d\varnothing} \quad \text{(II)}$$

In formulas (I) and (II), Ø is the azimuth angle (in radians) of the chain axis relative to the reference axis of interest. I(Ø) is the intensity along the azimuth angle at 2θ=22.8°. Within the orientation in the interest direction (or reference axis), f has a value between 0 and 1, where 1 means a higher degree of alignment relative to the reference axis.

The thermal stability of the aramid fiber and ANF-assembled filaments was studied using a thermogravimetric analyzer (TGA, SDT Q600, TA Instruments) performed at the rate of 10° C./min. The decomposition temperature was confirmed through derivative thermogravimetric analysis (DTG, 1st derivative of the TGA curve).

Mechanical characterization: Tensile testing was performed according to ASTM D3379 to evaluate the Young's modulus, tensile strength, strain at break, and toughness of the ANF-assembled filaments. As described in ASTM D3379, the filaments were attached to a sample holder made of heavy weight paper with epoxy such that a gauge length of 12.7 mm was obtained. The tests were carried out at a crosshead speed of 1.92 mm/min on a universal load frame (5982 series with a 5 N load cell, Instron), and ten specimens were tested for each condition.

Recycled ANF-assembled filaments: The recyclability of the ANF filaments was characterized from 0.3 g of ANF-assembled filaments prepared using a dilute acetone solution with a 0.2 wt % ANF colloidal suspension. The filaments were mechanically stirred with 150 mL of DMSO, 6 mL of DI water, and 0.45 g of KOH for 7 days to obtain a recycled ANFs colloidal suspension. Then, according to the same method described above, recycled ANF filaments were manufactured, and the mechanical properties were evaluated.

ANFs isolation and assembly: Nanoscale ANFs were obtained as a colloidal suspension in the DMSO-based system with various concentrations through the deprotonation and dissolution process described above. The ANF colloidal suspensions have a homogeneous red color and darken as the concentration increases. AFM images (not shown) of the ANFs shows a morphology of well-dispersed single ANFs through the mass protonation process and washing. The ANFs typically have diameters ranging from 4 to 12 nm and lengths of several micrometers, although larger diameters can be obtained by using an ANF colloidal suspension with a higher ANF concentration. Table 2 below summarizes the diameters of fabricated ANFs assembled fibers with different experimental conditions. The isolated ANFs are assembled hierarchically to form macroscale filaments through sequential wet spinning, stretching, and drying processes (FIG. 1). First, in the wet spinning step, prepared ANF colloidal suspensions were dispensed to the coagulant solution through a dispensing needle. Then, intermolecular bonds, including hydrogen bonds are formed by reprotonation of the ANFs by proton donors (water and/or HCl) in the coagulation bath resulting in the continuous formation of gel-state filaments along with the flow of the suspension. In this example, three different coagulation baths were evaluated for their effect on the protonation environment on the assembled macroscale ANF structure: (1) A solution of acetone diluted with water was used to create an environment with reduced rate of protonation due to the relatively lower density of proton donors (i.e., with acetone not being a proton donor), (2) DI water was used to obtain a moderate protonation rate, and (3) a dilute aqueous HCl solution was used to obtain rapid protonation (i.e., with the acid providing an additional proton source relative to the DI water medium) (FIG. 2). The rate of protonation contributes to the time and degree of bond formation among ANFs whose arrangement continuously changes along with the flow of the suspension. When the ANF colloidal suspensions pass through the needle, they align in the needle direction due to the shear forces; upon exiting the needle and entering the coagulation bath, however, the ANF alignment is momentarily lost due to reduced shear forces and die swell effect (FIG. 2). As the flow persists in this situation, the collapsed arrangement of ANFs is overcome by the shear stress between the fluid and drawing by gravitational force. Eventually, the ANFs become gradually assembled as they move a towards end of the needle with the length depending on the protonation rate. In other words, assembly in the HCl solution shows a fast reaction which provides a high probability for disorder while filaments spun into diluted acetone have increased alignment of ANFs due to relatively slow protonation rate (FIG. 2).

TABLE 2

Diameters of fabricated ANFs assembled fibers under different conditions.

| ANF Assembly Condition | Diameter (μm) |
|---|---|
| ANF-Acetone (0.2 wt %) | 5.81 ± 0.55 |
| ANF-Water (0.2 wt %) | 6.30 ± 0.52 |
| ANF-HCl (0.2 wt %) | 6.57 ± 0.53 |
| ANF-Acetone (0.5 wt %) | 12.48 ± 0.57 |
| ANF-Acetone (1.0 wt %) | 14.66 ± 0.85 |
| ANF-Acetone (1.5 wt %) | 17.61 ± 0.36 |

TABLE 2-continued

Diameters of fabricated ANFs assembled fibers under different conditions.

| ANF Assembly Condition | Diameter (μm) |
|---|---|
| ANF-Annealing | 5.61 ± 0.10 |
| ANF-Acetone (narrow) | 5.52 ± 0.18 |
| ANF-Recycling | 6.52 ± 0.15 |

Notes:
Coagulation baths included (1) 30 wt % acetone in DI water ("Acetone"), (2) DI water alone ("Water"), and (3) a 0.05M HCl aqueous solution in DI water ("HCl"). A wt. % value indicates the nominal ANF concentration in the colloidal suspension. "Annealing" indicates the inclusion of an annealing step. "(Narrow)" indicates the use of a narrower internal diameter needle for wet spinning. "Recycling" indicates the repetition of the process using already assembled ANF filaments.

Following protonation, the gel-state ANF-assembled filaments are then washed with DI water to remove residual KOH and DMSO, and drawn along their length to enhance the ANFs' hierarchical orientation and reduce pores generated among the entangled ANFs due to rapid precipitation. This example illustrates that it is possible to manufacture a rigid structure exhibiting high mechanical properties by eliminating these macro scaled pores and voids through a stretching process following wet spinning. Finally, the water molecules retained in the gel-state filaments are removed through a drying step, thereby generating a final intermolecular bond in the hierarchically ordered structure and finishing the assembly process. The assembled structure fabricated through the described processes is seen to be non-porous and to have well-aligned ANFs in the longitudinal direction based on cross-sectional SEM images of the filaments (not shown). Furthermore, the longitudinal order of the ANFs is evident in surface SEM images (not shown). The rough surface of the filaments can potentially work advantageously to form stable interfaces if embedded in a polymer matrix. EDS analysis (not shown) confirms no residual salts or other reactants remain in the filament. In addition, the toughness of the filament can be demonstrated through the formation of a knot with a small radius of curvature without the occurrence of any rupture or brittle failure. The abrasion resistance of the filament can be seen by the absence of the failure in a long filament loop pulled through a tight overhand knot. This demonstrates the high toughness, abrasion resistance, and strength of the ANF-assembled filament.

A subsequent annealing process was investigated to improve the strength and stiffness of the fabricated ANFs filaments. The use of a heat treatment with a specific temperature and time can alter the mechanical properties of polymer materials through further densification, reduction of internal stress, and provision of energy required for chemical reactions. In this example, a custom autoclave was used to anneal the filaments by simultaneously applying heat and pressure to filaments thereby densifying the microstructure, which was verified through SEM imaging (not shown).

The assembly of ANFs into a macro filament is achieved without the use of binders or cross-linkers, which is a fundamental bottom-up approach for assembly rather than forming a new type of ANF derivative or new molecular structures among the ANFs. The preservation of the molecular structure has been characterized through FTIR and XRD analysis. The FTIR spectra (not shown) of ANF-assembled filaments and aramid fibers show identical absorption peaks indicating that no change in chemical structure occurs during the dissolution, gel spinning, and drawing processes. Moreover, XRD analysis (not shown) indicates no change in peak locations between each experimental condition although the sharpness of peaks in the XRD patterns of ANF assembly is slightly diminished due to the decrease in the crystalline region, along with the reduced molecular density compared to the aramid fibers. The thermal characteristics of the ANF filaments and as-received KEVLAR fibers were analyzed for three separate cases: commercial aramid fibers, ANFs assembly within DI water, and annealed ANF-assembled filament to confirm the effect of annealing. The decomposition temperature of the ANF-assembled filament is 555.99° C. and increased to 558.07° C. through annealing, which values are slightly lower than the 576.45° C. decomposition temperature of the commercial aramid fibers (TGA and DTG data not shown). Aramid fibers possess a combination of high strength and thermal stability, and this result confirms that the ANF-assembled filaments retain the thermal stability of the precursor.

Mechanical properties of ANF-assembled filaments: The relationship between the protonation rate and the degree of ANF alignment according to the assembly mechanism was evaluated via the mechanical properties of the prepared filaments. Among the three different protonation environments, the maximum strength and modulus are obtained using a diluted acetone bath with a 0.2 wt % concentration of ANFs (FIG. 3, panel (A)). The dilute acetone solution provides a slow protonation rate which results in filaments with a high Young's modulus of 43.03±2.72 GPa and tensile strength of 1,353.64±92.98 MPa (FIG. 4). For comparison, filaments spun in a water bath show a modulus of 38.16±3.75 GPa and tensile strength of 1,234.40±60.69 MPa, while filaments spun in a HCl solution which provides rapid protonation have a modulus of 37.88±3.33 GPa and tensile strength of 1,166.51±92.01 MPa (FIG. 4). These results indicates that a slower protonation rate leads to increased modulus and strength of the filament. The measured mechanical properties also correlate to the degree of alignment of ANFs in the filaments, which is verified through the azimuthal angle scanning by XRD (not shown). The calculated orientation index f for the filaments is 0.44 in diluted acetone, 0.38 in water, and 0.37 in HCl solution, which means the filaments fabricated in diluted acetone are composed of the most significant number of well-aligned ANFs among the different three conditions.

Figure 3:
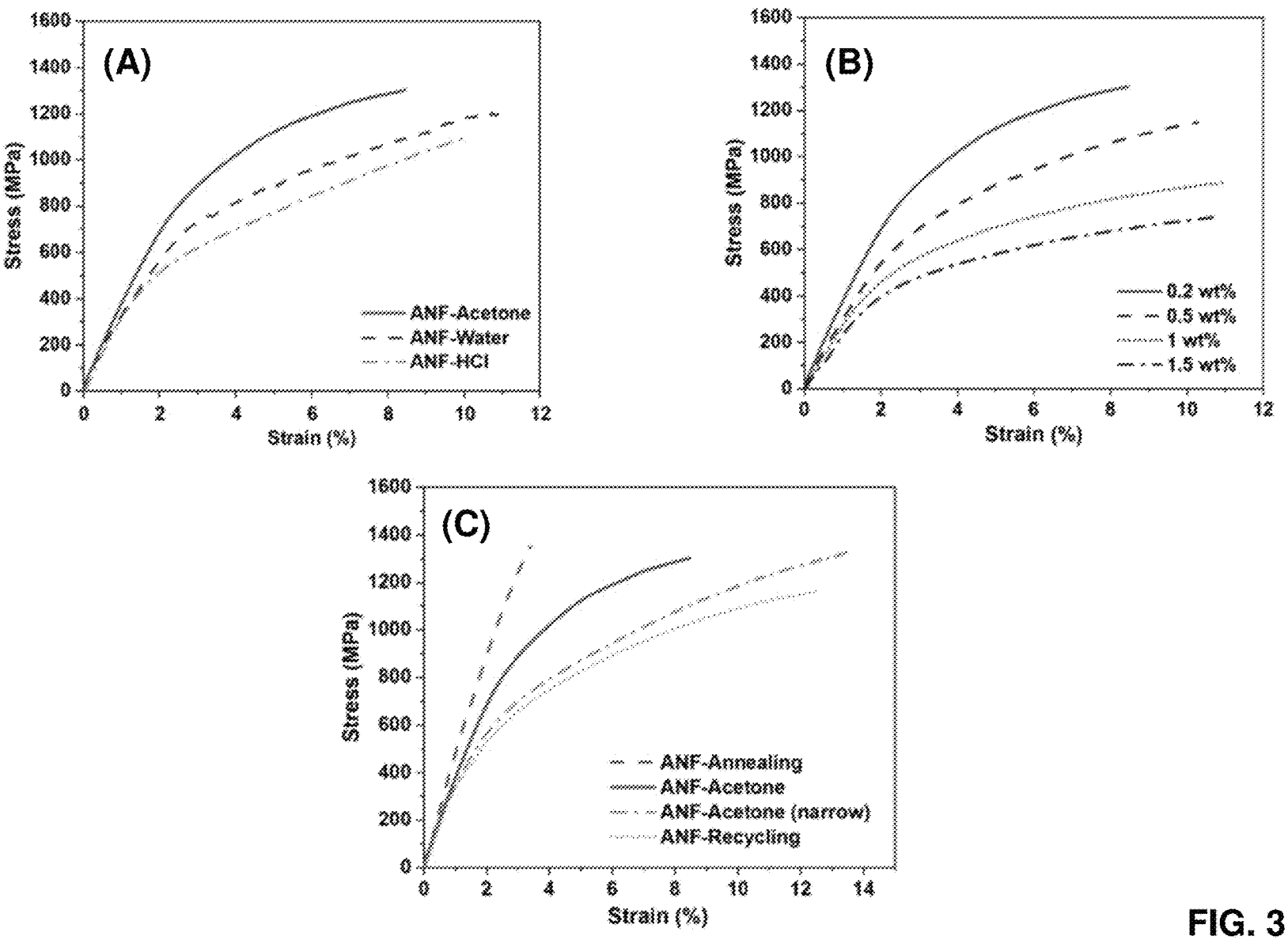
FIG. 3 includes graphs illustrating mechanical characteristics of ANF-assembled filaments according to the disclosure prepared under different conditions, including (A) variable coagulation bath composition, (B) variable concentration of ANFs in colloidal suspension, and (C) variable process steps such as an additional annealing process, a narrowed inner diameter of dispensing needle, and a recycling process on ANF-assembled filaments.
Figure 4:
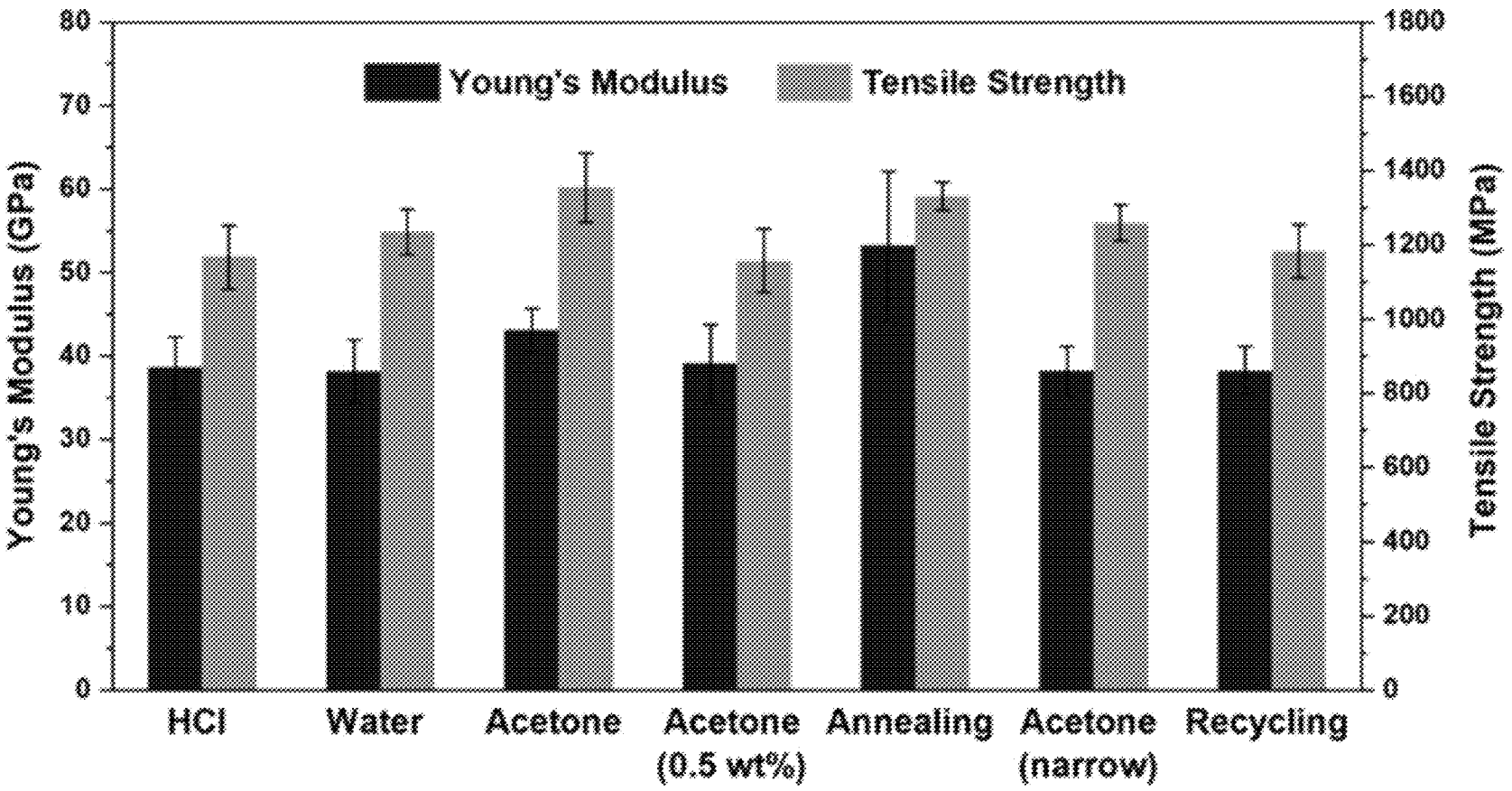
FIG. 4 is a graph illustrating Young's modulus and tensile strength values for ANF-assembled filaments according to the disclosure.

Similarly, to study the effect of ANF concentration in the colloidal suspension on the mechanical properties, tensile tests were performed on filaments fabricated with four different concentrations (0.2, 0.5, 1, and 1.5 wt. %) while the coagulation bath was fixed as diluted acetone (FIG. 3, panel (B)). The filaments made of 0.2 wt % ANFs colloidal suspension show the greatest mechanical properties in this example, while the Young's modulus and tensile strength decrease as the concentration increases. This results occurs due to the die swelling effect which is amplified with increased ANF concentration due to the increasing viscosity of the colloidal suspension with great ANF concentration, and then the arrangement of ANFs further collapse, which is demonstrated by the analysis of the X-ray azimuthal scanning on the prepared filament with different concentrations (not shown). The strength is further compromised by the size effect, with increased concentration in leading to an increase in the diameter of the finished filament due to a greater concentration of solids in the colloidal suspension (Table 1 above). Typically, the size of the structure is proportional to the density of defects which drive failure.

Furthermore, to study the effect of post-heat treatment on the mechanical properties of the filaments, tensile testing was conducted. The mechanical properties of annealed filaments, which previously showed a compact morphology, displayed a Young's modulus of 53.15±8.98 GPa and tensile strength of 1,330.20±38.00 MPa. Although the strain at break decreased through this additional annealing process, the elevated modulus is reported as the highest value in this study (FIG. 3, panel (C) and FIG. 4). This demonstrates that intermolecular bonding has been enriched due to heat and compression among aligned ANFs, which correlate to the TGA results.

Figure 5:
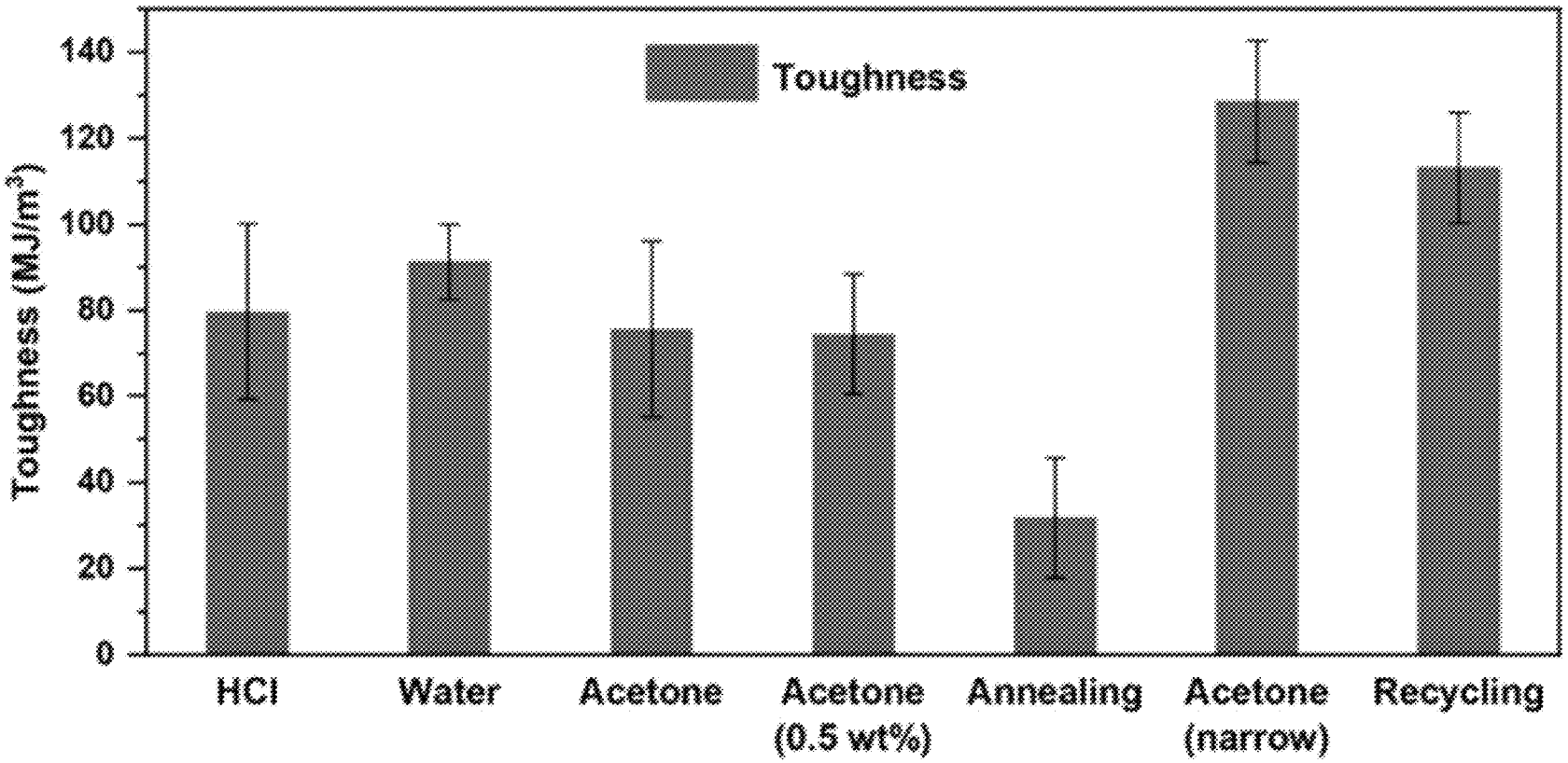
FIG. 5 is a graph illustrating toughness values for ANF-assembled filaments according to the disclosure.
Figure 6:
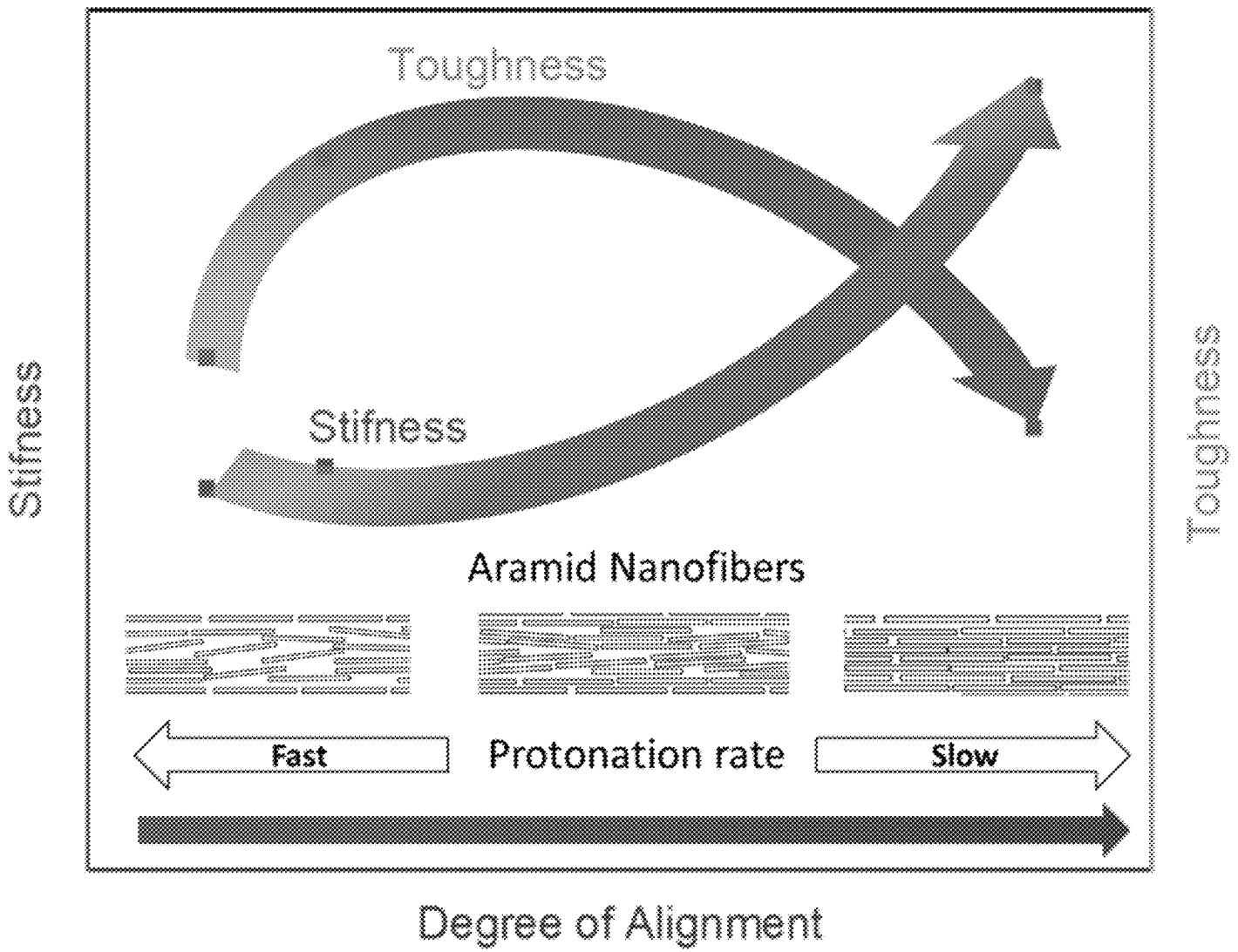
FIG. 6 qualitatively illustrates the relationship between ANF filament stiffness, ANF filament toughness, and degree of ANF alignment with different protonation rates and ANF network structure.

The exceptional toughness of aramid fibers is well known and therefore filaments composed of ANFs should similarly exhibit high toughness. The toughness of each filament was measured from the area under the tensile stress-strain curve. The results demonstrate a trade-off between toughness and modulus according to changes in ANFs orientation or additional annealing process (FIG. 4 and FIG. 5) when spinning parameters such as spinning speed and dispensing needle size are fixed. The ANF alignment decreases when the filaments are spun into water (f=0.38) compared to those prepared in diluted acetone (f=0.44), and consequently the Young's modulus and tensile strength decrease by 11.32% and 8.81%, respectively, while the toughness increases by 20.73%. However, analyzing the results from the filament spun into HCl solution, although they show the lowest degree of ANFs alignment (f=0.37), stiffness, and strength among the three conditions, they fail to show the highest toughness with the reduced stiffness. This implies that forming a hierarchical structure with entangled nanofibers is insufficient in the HCl solution due to the rapid rate of protonation, which eventually leads to relatively short elongation. This demonstrates that as the degree of ANFs alignment decreases, the filament toughness tends to increase under the stabilized conditions sufficient to form a nanofiber network, such as a slow protonation rate (FIG. 6).

The effect on toughness was evaluated by reducing the degree of alignment of ANFs based on the experimental condition with the 0.2 wt % ANFs colloidal suspension and diluted acetone as the coagulant bath, which produced high strength and stiffness fibers with the highest degree of ANFs alignment. To obtain higher disorder in the spun filament, a smaller diameter dispensing needle with an inner diameter of 100 μm was used (FIG. 3, panel (C), "(narrow)" result). The small diameter needle reduces the ANFs orientation since die swell becomes an important factor, and the drawing process is eliminated to account for the reduced diameter of the gel-state filaments. As a result, the filaments show the highest toughness values in this study of 128.66±14.13 $MJ/m^3$ (FIG. 5), an increase of more than 70% compared to the control group, while the modulus and strength only decreases by 11.27% and 6.99% (FIG. 4), respectively. The approach (e.g., reducing needle diameter and/or eliminating the drawing step) successfully improves toughness while maintaining much of the filament strength and stiffness, and demonstrates that the reduced protonation reaction volume with low ANFs orientation is able to form greater entanglement in the nanofiber networks leading to a tougher structure. On the other hand, the addition of an annealing step decreases toughness while improving modulus and strength, albeit modestly.

A comparative analysis was performed on the mechanical properties of commercial aramid fibers as precursors and manufactured filaments with various experimental conditions. The commercial aramid fiber (KEVLAR KM2+) properties were referenced from literature values with a Young's modulus of 84.62 GPa, a tensile strength of 3.88 GPa, and toughness of 80.25 $MJ/m^3$ from previous studies. The toughness of the filaments fabricated from diluted acetone as a control group have 94.31% of the precursor's properties, while the modulus and strength are 50.85% and 34.89%, respectively. Moreover, the toughness of the filaments prepared in diluted acetone with the narrow outlet corresponding to the highest value is equivalent to 160.32% of the aramid fibers, and Young's modulus of the filaments produced through the additional annealing process showing the highest value in this study corresponds to 62.81% of the precursor. In terms of tensile strength, unlike other properties that have changed significantly depending on the experimental conditions, its values only range from 31% to 35%, indicating signs of convergence.

The ANF-assembled filaments made by simultaneous protonation and wet spinning, have 60% greater toughness than commercial KEVLAR fibers while also having 4.86% lower density resulting is a vastly improved specific toughness. Given the importance of weight in fiber-reinforced polymer composites, this result shows that the ANF spun fibers could be used to create composite materials with high specific energy to break. Conventional synthetic fibers typically have a broad distribution of strength and modulus, while not exceeding an energy-to-break level of approximately 70 J/g (or up to about 80 J/g for the case of multilayered carbon nanotube yarns manufactured by the chemical vapor deposition spinning process). In this example, ANF-assembled filaments in the form of monofilament have shown the energy to break over 93 J/g, and this result demonstrates that it has impressive toughness exceeding other existing macroscale synthetic and natural fibers made of a single component. Furthermore, comparing the ANF-assembled filaments disclosed herein to spider silks, although the energy to break of the silk drawn from an adult *Nephila edulis* female under specific spinning conditions has been reported to be about 165 J/g, the ANF-assembled filaments have similar or higher toughness to the silk from *Argiope trifasciata* and Trichonephila clavipes. Moreover, the ANF filaments exhibit a specific strength in the range from 945.80 to 1016.29 MPa $g^{-1}cm^3$ and a specific modulus from 28.50 to 39.90 GPa $g^{-1}cm^3$, which are higher than polyamide (PA), poly(meta-phenylene isophtalamide) (MPIA), and natural fibers such as spider silk and nanocellulose fiber. In particular, the strong modulus with high toughness is advantageous for stable energy absorption in the early stage of impact. Therefore, the disclosed ANF-assembled filaments can be used in structural applications requiring mechanical properties beyond those of other existing fibers.

The problem of environmental pollution related to synthetic fibers that are discard after damage or other use is significant. To address this issue, a recycling experiment was conducted to re-fabricate the filaments in a recycling process by dissolving the prepared filaments into a DMSO/water/KOH system through re-deprotonation, and then repeating the disclosed assembly process. Consequently, the recycled filaments have Young's modulus of 38.25±2.91 GPa, showing essentially no difference from a previous experimental case of ANF-acetone (narrow) (FIG. 3, panel (C) and FIG. 4). However, the tensile strength and toughness decreased by approximately 6% and 12%, respectively, to 1,182.70±71.96 MPa and 113.19±12.83 $MJ/m^3$ (FIG. 4 and FIG. 5). Although this is considered a chemical degradation due to repeated deprotonation during the recycling process, the recycled filaments still display high mechanical properties, indicating its use as a sustainable, recyclable material.

Summary: This example illustrates the use of ANF filaments as sustainable, functional synthetic fibers by assembling the nanofibers into a macroscale structure with lightweight and outstanding mechanical properties. The ANF assembly was established by simultaneous protonation and wet spinning, thereby fabricating the ANF-assembled filaments with remarkable toughness beyond the precursors. Although the prepared filaments have the same crystalline and chemical structure as commercial aramid fibers and are eventually formed by physical intermolecular bonds with the same mechanism as precursors, a unique ANFs network leads to notable mechanical properties. The ANF-assembled filament has high toughness, specific strength and modulus, inherited thermal stability and sustainability that can be useful in structural applications in broad areas, including transportation, aerospace, safety supplies, and medical engineering. Furthermore, the disclosed process has low energy consumption and provides a low-cost, simple, and scalable procedure for continuous manufacturing, which makes it possible to be used in various functional fiber applications with expanded properties by forming a composite with other functional materials.

Example 2—ANF Nanocomposite Filaments

This example illustrates the assembly and mechanical characterization of aramid nanofibers (ANFs) into nanocomposite filaments for manufacturing high strength and high modulus 3D structures. The fabrication process includes homogeneous stirring of a nanomaterial dispersion and wet spinning into a coagulant solution through a spinning nozzle. The ANFs were initially isolated from aramid fabric using deprotonation methods and used to prepare polyamide-imide (PAI) or cellulose nanofibers (CNFs) nanocomposites. The fabricated ANF/PAI nanocomposite filaments displayed a Young's modulus of about 13.6 GPa, and tensile strength of about 311.8 MPa. The fabricated ANF/CNF nanocomposite filaments exhibited a Young's modulus of about 31.4 GPa, and tensile strength of about 353.6 MPa. This example shows that ANFs based nanocomposites are designed with simplified and cost-effective production to develop them into high-strength 3D printing materials.

The aramid nanofibers (ANFs) are of a high aspect ratio with a nano-sized diameter and micro-scaled length, which are dissembled from poly(p-phenylene terephthalamide) (PPTA), also known as KEVLAR. PPTA comprises highly aligned molecular chains with dense hydrogen bonds, resulting in excellent elastic modulus and strength comparable to carbon fiber. The ANFs have outstanding mechanical properties. However, a material formed only from ANFs can have the disadvantage of poor formability for various types of structures. To expand the potential applications to various manufacturing platforms such as 3D printing as solid materials, the ANF-based nanocomposites such as those in this example or with other polymer matrices can be used.

The polyamide-imides (PAIs) are amorphous thermoplastics with outstanding strength, stiffness, wear resistance, and inherent flame resistance, also known as TORLON. They can be molded with high processing temperature for parts of space structures and automotive components such as bearings and thermal insulators. Typically, due to the severe process environment, the filler materials as reinforcements for PAIs have been limited to glass or carbon fibers. However, ANFs can be employed with high thermal stability and shows improvement in mechanical properties through amide-amide hydrogen bonding.

Cellulose nanofibers (CNFs) can be used as a nanoscale building block with high specific modulus and strength, environmentally-friendliness, and sustainability. The numerous hydrophilic functions on the CNF surface can also induce dense hydrogen bonds with morphologically similar ANFs as a one-dimensional nanofiber.

In this example, two different nanocomposites, ANF/PAI and ANF/CNF nanocomposites, were prepared and analyzed by scanning electron microscopy for their morphology and by tensile testing for their mechanical properties.

Isolation of ANFs: ANFs were isolated by dissolving macroscale aramid fibers (KM2+, CS-800) in 300 mL of dimethyl sulfoxide (DMSO, ACS certified, Fisher Scientific)/deionized (DI) water/potassium hydroxide (KOH, ACS certified, Fisher Scientific) solution over one day under magnetic stirring at room temperature to obtain a red transparent suspension of ANFs with a solid content of 0.2 wt %. Then, an equal volume of DI water was added to the fully dissolved ANFs suspension to isolate ANFs by reducing the solubility and precipitating the ANFs. The precipitate was collected and washed using a vacuum filtering system with plenty of DI water to remove salt and remaining solvent. Finally, the washed ANFs were collected and kept in a sealed container to prevent dryness.

Fabrication of ANF/PAI nanocomposites: For ANF/PAI nanocomposites, ANFs were first dispersed in DMSO by horn sonication, and the solvent was slowly evaporated in the stirring system with heating to get rid of residual water molecules as much as possible for 12 hours. PAI (TORLON 4000TF; Solvay) was also dissolved in DMSO through magnetic stirring and combined with the ANFs suspension through additional sonication to yield an ANF weight fraction of 1.5 wt % in the nanocomposite. Then, the heated homogenous suspension, total solid content of 28 wt %, was wet spun into a coagulation baDI water and acetone (ACS certified, Fisher Scientific)/DMSO mixture through a spinning nozzle with 250 μm inner diameter and 50 mm length. Then, the coagulated ANF/PAI nanocomposite filaments were collected and dried at 135° C. for 24 h in a vacuum oven to remove the solvent. To achieve maximum properties, the dried filaments were post-cured at 260° C. for 48 h in a convection oven.

Fabrication of ANF/CNF nanocomposites: For ANF/CNF nanocomposites, a DI water-based CNFs suspension (supplied from Inha University, South Korea) and the isolated ANFs suspension were stirred by horn sonication to get an ANF weight ratio of 10 wt % and 50 wt % in the nanocomposite. The homogeneous suspension, total solid content of 2 wt %, was wet spun into a 5 wt % calcium chloride dihydrate ($CaCl_2$), ACS certified, Fisher Scientific) aqueous solution for coagulation. Then, the coagulated nanocomposite filaments were washed with DI water to remove the non-reacted ions and dried at 50° C. for 24 h in the convection oven.

Characterization: The mechanical properties were investigated in terms of Young's modulus and tensile strength using an Instron universal load frame (Model 5982) with a 5 N load cell at room temperature (ASTM D3379). All tensile test specimens were prepared with a gauge length of 12.5 mm, and 10 specimens were tested for each nanocomposite. A scanning electron microscope (SEM, JEOL 7800 FLV, Japan) was used for the morphology analysis of fabricated nanocomposite filaments.

Results: In the case of the ANF/PAI nanocomposite, the solubility of the nanomaterials in the suspension flow has been lowered through solvent exchange through wet spinning to the coagulation bath. Then, this reaction eventually leads to phase separation, forming the final structure. In this example, for efficient phase separation, a high suspension concentration was employed. Regarding the ANF weight fraction in the nanocomposite, a 1.5 wt % ANF with PAI matrix provides improved mechanical properties via amide-amide hydrogen bonding. On the other hand, the high solid contents of the nanocomposite suspension induces a porous structure through the manufacturing process in a DI water bath, which degrades mechanical properties. To solve this problem, the phase separation rate has slowed down by using an acetone/DMSO mixing solution as a coagulant agent, and a pore-reduced filament structure (FIG. 2*a*) that displays the improved mechanical properties can be formed. According to the morphology of the nanocomposite surface, a smoother surface is observed in a fast phase separation environment. With the water bath, the nanocomposite filaments show have Young's modulus and tensile strength values of 0.88±0.19 GPa and 23.27±3.99 MPa, respectively. When the filaments are prepared in an acetone/DMSO coagulation bath, they exhibit Young's modulus and tensile strength values of 10.20±2.22 GPa and 251.68±36.45 MPa, respectively. The ANF/PAI nanocomposites show more than 1059% and 981% increase in Young's modulus and tensile strength through the modified coagulation condition.

In the case of the ANF/CNF nanocomposite, sodium ($Na^+$) ions serving as dispersants in the CNF network are exchanged with calcium ($Ca^{2+}$) ions in the $CaCl_2$ solution during wet spinning, thereby generating intermolecular bonds among the cellulose chain and gelation. Moreover, hydrogen bonds between ANFs and CNFs are also formed through a drying process following the gelation, finally forming the ANF/CNF nanocomposite. The suspension's solid nanocomposite content was 2 wt %, showing favorable ion diffusion condition in wet spinning. Therefore, morphology and mechanical properties of the nanocomposite produced by varying ANF weight fraction (10 wt % and 50 wt %) within the fixed total solids contents have been studied. According to the morphology analysis, it was found that at increasing the ANF ratios, a rougher surface as well as fracture area resulted. This is due to the difference in the composition ratio of ANFs with a relatively larger size than CNF and the degree of intermolecular bonding by the ion exchange within the CNFs network. With the 10 wt % ANF fraction, the nanocomposite filaments had Young's modulus and tensile strength values of 14.90±1.76 GPa and, 242.86±37.16 MPa, respectively. When the 50 wt % ANF fraction, the nanocomposite filaments had Young's modulus and tensile strength values of 24.67±4.93 GPa and 310.48±18.60 MPa, respectively. The ANF/CNF nanocomposites show more than 77% and 27% increase in Young's modulus and tensile strength through the ANF weight fraction increase to 50 wt % from 10 wt %.

Because other modifications and changes varied to fit particular operating requirements and environments will be apparent to those skilled in the art, the disclosure is not considered limited to the example chosen for purposes of illustration, and covers all changes and modifications which do not constitute departures from the true spirit and scope of this disclosure.

Accordingly, the foregoing description is given for clearness of understanding only, and no unnecessary limitations should be understood therefrom, as modifications within the scope of the disclosure may be apparent to those having ordinary skill in the art.

All patents, patent applications, government publications, government regulations, and literature references cited in this specification are hereby incorporated herein by reference in their entirety. In case of conflict, the present description, including definitions, will control.

Throughout the specification, where the compositions, processes, kits, or apparatus are described as including components, steps, or materials, it is contemplated that the compositions, processes, or apparatus can also comprise, consist essentially of, or consist of, any combination of the recited components or materials, unless described otherwise. Component concentrations can be expressed in terms of weight concentrations, unless specifically indicated otherwise. Combinations of components are contemplated to include homogeneous and/or heterogeneous mixtures, as would be understood by a person of ordinary skill in the art in view of the foregoing disclosure.

What is claimed is:

1. A method for forming nanofiber-assembled filaments, the method comprising:

providing a nanofiber suspension comprising aromatic polyamide nanofibers dispersed therein, wherein (i) the nanofiber suspension comprises a suspension medium comprising water, deprotonated aromatic polyamide nanofibers as the aromatic polyamide nanofibers, a water-miscible solvent for the deprotonated aromatic polyamide nanofibers, and a base, and (ii) the water-miscible solvent comprises at least one of dimethyl sulfoxide (DMSO), N-methyl-2-pyrrolidone (NMP), and methyl ethyl ketone (MEK);

wet-spinning the nanofiber suspension into a coagulation medium comprising at least one non-solvent for the aromatic polyamide nanofibers and at least one proton donor, thereby forming wet nanofiber-assembled filaments in the coagulation medium;

optionally washing the wet nanofiber-assembled filaments;

drawing the wet nanofiber-assembled filaments, thereby reducing or removing voids in the nanofiber-assembled filaments;

optionally drying the wet nanofiber-assembled filaments, thereby forming dry nanofiber-assembled filaments; and optionally annealing the dry nanofiber-assembled filaments, thereby forming annealed nanofiber-assembled filaments.

2. The method of claim 1, wherein the aromatic polyamide of the nanofibers is selected from the group consisting of aromatic polyamide homopolymers, polyamide copolymers, and combinations thereof.

3. The method of claim 1, wherein the aromatic polyamide nanofiber comprises aromatic polyamide repeat units selected from $—(NH—C_6H_4—NHCO—C_6H_4—CO)_n—$, $—(NH—C_6H_4—CO)_n—$, and combinations thereof.

4. The method of claim 1, wherein:

the aromatic polyamide nanofibers have a diameter in a range of 1 nm to 500 nm; and the aromatic polyamide nanofibers have a length in a range of 0.5 μm to 250 μm.

5. The method of claim 1, wherein:

the nanofiber suspension contains the deprotonated aromatic polyamide nanofibers in an amount of 0.001 wt. % to 5 wt. % based on the nanofiber suspension.

6. The method of claim 1, wherein the coagulation medium comprises water as the at least one non-solvent and the at least one proton donor.

7. The method of claim 1, wherein the coagulation medium comprises an acid as the at least one proton donor.

8. The method of claim 1, wherein the coagulation medium comprises an aprotic solvent as the non-solvent for the aromatic polyamide nanofibers.

9. The method of claim 1, wherein the coagulation medium comprises at least one of a crosslinker, a reinforcement material, a binder, and a functional component.

10. The method of claim 1, comprising washing the wet nanofiber-assembled filaments.

11. The method of claim 1, wherein drawing the wet nanofiber-assembled filaments comprises subjecting the wet nanofiber-assembled filaments to an extensional strain of at least 2%.

12. The method of claim 1, comprising drying the wet nanofiber-assembled filaments.

13. The method of claim 1, comprising annealing the nanofiber-assembled filaments.

14. The method of claim 1, further comprising:

repeating the steps of claim 1 to form a plurality of nanofiber-assembled filaments; and assembling the plurality of nanofiber-assembled filaments into a composite structure having a predetermined geometry.

15. The method of claim 1, wherein the nanofiber-assembled filaments have at least one of the following properties:

a Young's modulus of at least 30 GPa;

a tensile strength of at least 600 MPa;

a toughness of at least 30 $MJ/m^3$; and an orientation index of at least 0.3.

16. The method of claim 1, wherein the nanofiber-assembled filaments have a diameter in a range of 1 μm to 50 μm.

17. The method of claim 1, wherein the filaments are formed in the absence of binders and/or crosslinkers.

18. A method for forming nanofiber-assembled filaments, the method comprising:

providing a nanofiber suspension comprising aromatic polyamide nanofibers dispersed therein, wherein (i) the nanofiber suspension comprises a suspension medium comprises water, deprotonated aromatic polyamide nanofibers as the aromatic polyamide nanofibers, a water-miscible solvent for the deprotonated aromatic polyamide nanofibers, and a base, and (ii) the water-miscible solvent comprises at least one of dimethyl sulfoxide (DMSO), N-methyl-2-pyrrolidone (NMP), and methyl ethyl ketone (MEK); and wet-spinning the nanofiber suspension into a coagulation medium comprising at least one non-solvent for the aromatic polyamide nanofibers and at least one proton donor, thereby forming wet nanofiber-assembled filaments in the coagulation medium;

wherein:

the coagulation medium comprises at least one of (i) an acid as the at least one proton donor, and (ii) an aprotic solvent as the non-solvent for the aromatic polyamide nanofibers.

19. The method of claim 18, wherein the coagulation medium comprises the acid as the at least one proton donor.

20. The method of claim 18, wherein the coagulation medium comprises the aprotic solvent as the non-solvent for the aromatic polyamide nanofibers.

21. The method of claim 18, further comprising:

washing the wet nanofiber-assembled filaments;

drawing the wet nanofiber-assembled filaments, thereby reducing or removing voids in the nanofiber-assembled filaments;

drying the wet nanofiber-assembled filaments, thereby forming dry nanofiber-assembled filaments; and annealing the dry nanofiber-assembled filaments, thereby forming annealed nanofiber-assembled filaments.

22. A method for forming nanofiber-assembled composite filaments, the method comprising:

providing a nanofiber suspension comprising (i) aromatic polyamide nanofibers dispersed therein, and (ii) an additional polymeric material dissolved or dispersed in the suspension, wherein (a) the nanofiber suspension comprises a suspension medium comprising water, deprotonated aromatic polyamide nanofibers as the aromatic polyamide nanofibers, a water-miscible solvent for the deprotonated aromatic polyamide nanofibers, and a base, and (b) the water-miscible solvent comprises at least one of dimethyl sulfoxide (DMSO), N-methyl-2-pyrrolidone (NMP), and methyl ethyl ketone (MEK); and wet-spinning the nanofiber suspension into a coagulation medium comprising at least one non-solvent for the aromatic polyamide nanofibers and optionally at least one proton donor, thereby forming wet nanofiber-assembled composite filaments in the coagulation medium.

23. The method of claim 22, wherein:

the additional polymeric material comprises cellulose nanofibers; and the coagulation medium further comprises a crosslinker.

24. The method of claim 22, wherein the additional polymeric material comprises polyamide-imide (PAI).

25. A method for recycling aromatic polyamide fibers, the method comprising:

forming a nanofiber suspension from one or more of an aromatic polyamide fiber, fabric, or filament material by converting the aromatic polyamide fiber, fabric, or filament material to aromatic polyamide nanofibers dispersed in a nanofiber suspension, wherein (i) the nanofiber suspension comprises a suspension medium comprising water, deprotonated aromatic polyamide nanofibers as the aromatic polyamide nanofibers, a water-miscible solvent for the deprotonated aromatic polyamide nanofibers, and a base, and (ii) the water-miscible solvent comprises at least one of dimethyl sulfoxide (DMSO), N-methyl-2-pyrrolidone (NMP), and methyl ethyl ketone (MEK);

wet-spinning the nanofiber suspension into a coagulation medium comprising at least one non-solvent for the aromatic polyamide nanofibers and at least one proton donor, thereby forming wet nanofiber-assembled filaments in the coagulation medium;

optionally washing the wet nanofiber-assembled filaments;

drawing the wet nanofiber-assembled filaments, thereby reducing or removing voids in the nanofiber-assembled filaments;

optionally drying the wet nanofiber-assembled filaments, thereby forming dry nanofiber-assembled filaments; and optionally annealing the dry nanofiber-assembled filaments, thereby forming annealed nanofiber-assembled filaments.

* * * * *